US008288931B2

(12) United States Patent
Fukuzawa et al.

(10) Patent No.: US 8,288,931 B2
(45) Date of Patent: Oct. 16, 2012

(54) SPARK PLUG HAVING A CENTER ELECTRODE AND A GROUND ELECTRODE PROVIDED WITH NO NOBLE METAL MEMBER

(75) Inventors: Reimon Fukuzawa, Aichi (JP); Hiroaki Masuda, Nisshin (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 12/999,417

(22) PCT Filed: Jun. 4, 2009

(86) PCT No.: PCT/JP2009/002521
§ 371 (c)(1),
(2), (4) Date: Dec. 16, 2010

(87) PCT Pub. No.: WO2009/153927
PCT Pub. Date: Dec. 23, 2009

(65) Prior Publication Data

US 2011/0089807 A1 Apr. 21, 2011

(30) Foreign Application Priority Data

Jun. 18, 2008 (JP) ..... 2008-158992
Nov. 27, 2008 (JP) ..... 2008-302219

(51) Int. Cl.
*H01T 13/32* (2006.01)

(52) U.S. Cl. ..... 313/141; 313/142; 313/143; 123/169 R; 123/169 EL

(58) Field of Classification Search ..... 313/118–145; 123/169 R, 169 EL, 32, 41, 310
See application file for complete search history.

(56) References Cited

U.S. PATENT DOCUMENTS

2007/0216275 A1 9/2007 Torii et al.
2007/0228915 A1 10/2007 Honda et al.

FOREIGN PATENT DOCUMENTS

JP 54-150525 A 11/1979
JP 58-59579 A 4/1983
JP 2007-250344 A 9/2007
JP 2007-250379 A 9/2007
JP 2007-287667 A 11/2007

OTHER PUBLICATIONS

A Translation of the International Preliminary Report on Patentability,Feb. 2011.*

* cited by examiner

*Primary Examiner* — Tracie Y Green
(74) *Attorney, Agent, or Firm* — Sughrue Mion, PLLC

(57) ABSTRACT

The ignitability of a spark plug configured without a noble metal for a center electrode and a ground electrode is improved. The spark plug comprises a center electrode, an insulator, a metal shell, and a ground electrode including a discharge surface. The ground electrode forms a spark gap between the discharge surface and the center electrode. The center electrode and the ground electrode both do not include a noble metal. The ground electrode comprises a proximal end portion combined with the metal shell and positioned above, the discharge surface and a distal end portion including the discharge surface and positioned below the proximal end portion while continued from the proximal end portion. A width Da of the center electrode viewed from a first direction and a width Db of the proximal end portion viewed from the first direction satisfy Db/Da≦0.92. The first direction is perpendicular to the axial direction and directing from the proximal end portion to the center electrode.

12 Claims, 24 Drawing Sheets

| No | CENTER ELECTRODE WIDTH Da (mm) | GROUND ELECTRODE WIDTH Db (mm) | Db/Da | IGNITABILITY REDUCTION RATE (%) | DETERMI-NATION |
|---|---|---|---|---|---|
| #1 | 1.5 | 1.30 | 0.87 | 92.9 | ○ |
| #2 | 1.5 | 1.35 | 0.90 | 92.0 | ○ |
| #3 | 1.5 | 1.37 | 0.91 | 91.3 | ○ |
| #4 | 1.5 | 1.38 | 0.92 | 90.8 | ○ |
| #5 | 1.5 | 1.40 | 0.93 | 88.7 | △ |
| #6 | 1.5 | 1.45 | 0.97 | 86.0 | △ |
| #7 | 1.5 | 1.47 | 0.98 | 84.9 | △ |
| #8 | 1.5 | 1.49 | 0.99 | 83.8 | × |
| #9 | 1.5 | 1.50 | 1.00 | 83.2 | × |
| #10 | 1.5 | 1.55 | 1.03 | 80.7 | × |
| #11 | 1.5 | 1.60 | 1.07 | 78.4 | × |

| No | CENTER ELECTRODE WIDTH Da (mm) | GROUND ELECTRODE WIDTH Db (mm) | Db/Da | IGNITABILITY REDUCTION RATE (%) | DETERMI-NATION |
|---|---|---|---|---|---|
| #21 | 2.0 | 1.75 | 0.88 | 93.2 | ○ |
| #22 | 2.0 | 1.80 | 0.90 | 92.4 | ○ |
| #23 | 2.0 | 1.82 | 0.91 | 91.6 | ○ |
| #24 | 2.0 | 1.84 | 0.92 | 90.8 | ○ |
| #25 | 2.0 | 1.86 | 0.93 | 89.3 | △ |
| #26 | 2.0 | 1.93 | 0.97 | 86.4 | △ |
| #27 | 2.0 | 1.95 | 0.98 | 85.2 | △ |
| #28 | 2.0 | 1.98 | 0.99 | 84.0 | × |
| #29 | 2.0 | 2.00 | 1.00 | 83.4 | × |
| #30 | 2.0 | 2.05 | 1.03 | 80.8 | × |
| #31 | 2.0 | 2.10 | 1.05 | 78.6 | × |

FIG. 10 (A)
| | CENTER ELECTRODE WIDTH (Da) | GROUND ELECTRODE WIDTH (Db) | Da/Db |
|---|---|---|---|
| COMPARATIVE EXAMPLE #41 | 1.5 | 1.7 | 1.13 |
| EXAMPLE #42 | 1.5 | 1.3 | 0.87 |
FIG. 10 (B)
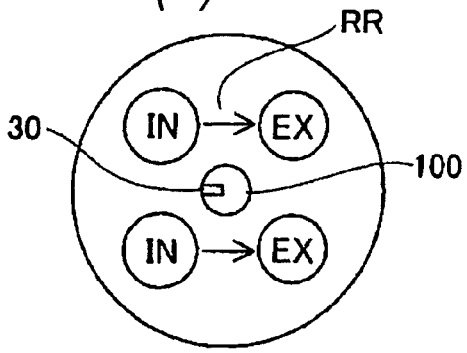
FIG. 10 (C)
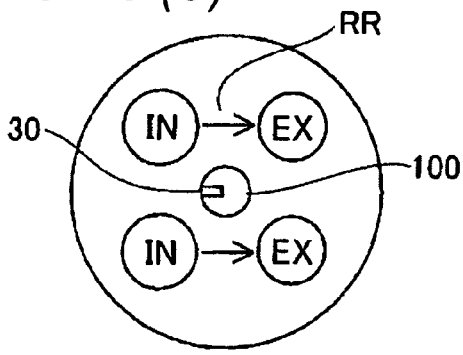
FIG. 10 (D)
| | PLUG DIRECTION | STABLE COMBUSTION LIMIT ADVANCE ANGLE (DEGREE) | IGNITABILITY REDUCTION RATE (%) |
|---|---|---|---|
| COMPARATIVE EXAMPLE #41 | IN SIDE | 20 | 74.1 |
| | EX SIDE | 27 | |
| EXAMPLE #42 | IN SIDE | 26 | 92.9 |
| | EX SIDE | 28 | |
FIG. 10 (E)
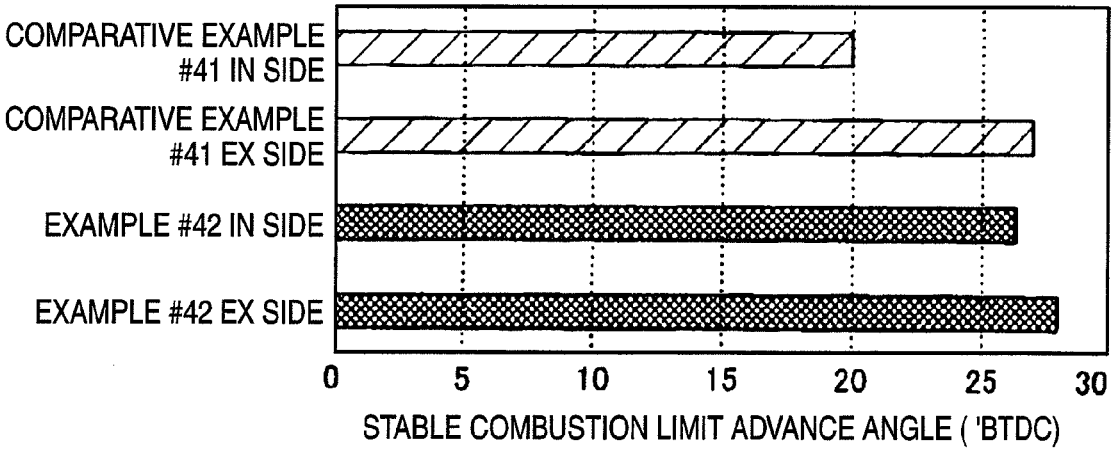

| No | CENTER ELECTRODE WIDTH Da (mm) | GROUND ELECTRODE WIDTH Db (mm) | Db/Da | GROUND ELECTRODE R (mm) | IGNITABILITY REDUCTION RATE (%) | DETERMI-NATION |
|---|---|---|---|---|---|---|
| #71 | 1.5 | 1.30 | 0.87 | 0.3 | 98.3 | ○ |
| #72 | 1.5 | 1.35 | 0.90 | 0.3 | 98.0 | ○ |
| #73 | 1.5 | 1.40 | 0.93 | 0.3 | 97.5 | ○ |
| #74 | 1.5 | 1.45 | 0.97 | 0.3 | 95.0 | ○ |
| #75 | 1.5 | 1.47 | 0.98 | 0.3 | 93.0 | ○ |
| #76 | 1.5 | 1.49 | 0.99 | 0.3 | 91.2 | ○ |
| #77 | 1.5 | 1.50 | 1.00 | 0.3 | 88.4 | △ |
| #78 | 1.5 | 1.55 | 1.03 | 0.3 | 84.7 | △ |

| No | CENTER ELECTRODE WIDTH Da (mm) | GROUND ELECTRODE WIDTH Db (mm) | Db/Da | GROUND ELECTRODE R (mm) | IGNITABILITY REDUCTION RATE (%) | DETERMI-NATION |
|---|---|---|---|---|---|---|
| #81 | 2.0 | 1.75 | 0.88 | 0.3 | 98.8 | ○ |
| #82 | 2.0 | 1.80 | 0.90 | 0.3 | 98.4 | ○ |
| #83 | 2.0 | 1.85 | 0.93 | 0.3 | 97.9 | ○ |
| #84 | 2.0 | 1.90 | 0.95 | 0.3 | 95.5 | ○ |
| #85 | 2.0 | 1.95 | 0.98 | 0.3 | 93.4 | ○ |
| #86 | 2.0 | 1.98 | 0.99 | 0.3 | 91.1 | ○ |
| #87 | 2.0 | 2.00 | 1.00 | 0.3 | 88.5 | △ |
| #88 | 2.0 | 2.05 | 1.03 | 0.3 | 85.6 | △ |

FIG. 14 (A)
| | CENTER ELECTRODE WIDTH (Da) | GROUND ELECTRODE WIDTH (Db) | Da/Db |
|---|---|---|---|
| COMPARATIVE EXAMPLE #91 | 1.5 | 1.7 | 1.13 |
| EXAMPLE #92 | 1.5 | 1.3 | 0.87 |
FIG. 14 (B)
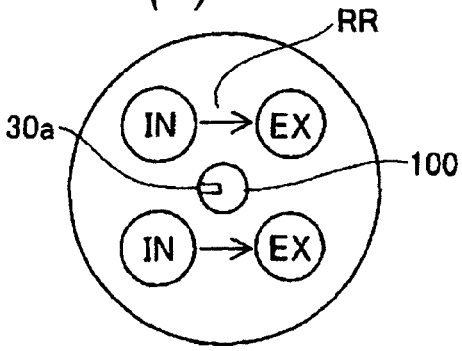
FIG. 14 (C)
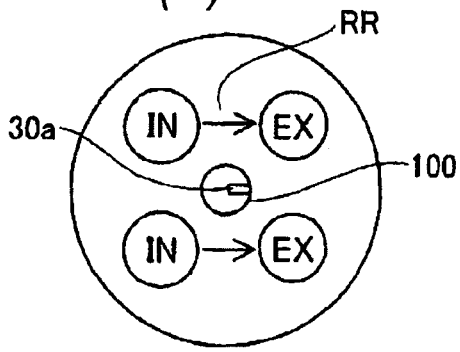
FIG. 14 (D)
| | PLUG DIRECTION | STABLE COMBUSTION LIMIT ADVANCE ANGLE (DEGREE) | IGNITABILITY REDUCTION RATE (%) |
|---|---|---|---|
| COMPARATIVE EXAMPLE #91 | IN SIDE | 20 | 74.1 |
| | EX SIDE | 27 | |
| EXAMPLE #92 | IN SIDE | 28 | 98.3 |
| | EX SIDE | 28.5 | |
FIG. 14 (E)
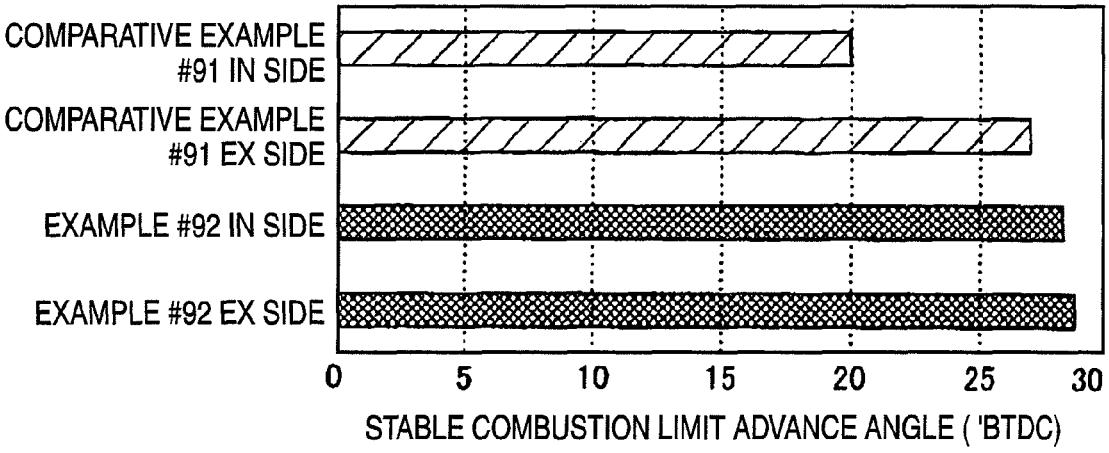

| No | CENTER ELECTRODE WIDTH | GROUND ELECTRODE WIDTH | Db/Da | GROUND ELECTRODE | IGNITABILITY REDUCTION RATE (%) | DETERMI-NATION |
|---|---|---|---|---|---|---|
| | Da (mm) | Db (mm) | | R (mm) | | |
| #101 | 1.5 | 1.49 | 0.99 | 0.0 | 83.8 | × |
| #102 | 1.5 | 1.49 | 0.99 | 0.1 | 86.4 | △ |
| #103 | 1.5 | 1.49 | 0.99 | 0.2 | 88.9 | △ |
| #104 | 1.5 | 1.49 | 0.99 | 0.3 | 91.2 | ○ |
| #105 | 1.5 | 1.49 | 0.99 | 0.4 | 92.4 | ○ |
| #106 | 1.5 | 1.49 | 0.99 | 0.6 | 93.5 | ○ |

| No | CENTER ELECTRODE WIDTH Da (mm) | GROUND ELECTRODE WIDTH Db (mm) | Db/Da | GROUND ELECTRODE R (mm) | IGNITABILITY REDUCTION RATE (%) | DETERMI-NATION |
|---|---|---|---|---|---|---|
| #111 | 2.0 | 1.98 | 0.99 | 0.0 | 84.0 | × |
| #112 | 2.0 | 1.98 | 0.99 | 0.1 | 86.8 | △ |
| #113 | 2.0 | 1.98 | 0.99 | 0.2 | 89.2 | △ |
| #114 | 2.0 | 1.98 | 0.99 | 0.3 | 91.1 | ○ |
| #115 | 2.0 | 1.98 | 0.99 | 0.4 | 92.5 | ○ |
| #116 | 2.0 | 1.98 | 0.99 | 0.6 | 93.8 | ○ |

| No | GROUND ELECTRODE SECTIONAL AREA ($mm^2$) | GAP INCREASE (mm) | DETERMI-NATION |
|---|---|---|---|
| #61 | 2.4 | 0.14 | ○ |
| #62 | 1.6 | 0.16 | ○ |
| #63 | 1.0 | 0.19 | ○ |
| #64 | 0.8 | 0.24 | × |

| No | CENTER ELECTRODE WIDTH Da (mm) | GROUND ELECTRODE WIDTH Db (mm) | Db/Da | GROUND ELECTRODE Sa (mm) | IGNITABILITY REDUCTION RATE (%) | DETERMI-NATION |
|---|---|---|---|---|---|---|
| #201 | 1.5 | 1.30 | 0.87 | 1.30 | 99.1 | ○ |
| #202 | 1.5 | 1.38 | 0.92 | 1.38 | 98.2 | ○ |
| #203 | 1.5 | 1.49 | 0.99 | 1.49 | 91.7 | ○ |
| #204 | 1.5 | 1.50 | 1.00 | 1.50 | 89.8 | △ |
| #205 | 1.5 | 1.55 | 1.03 | 1.55 | 88.7 | △ |

| No | CENTER ELECTRODE WIDTH | GROUND ELECTRODE WIDTH | Db/Da | GROUND ELECTRODE | IGNITABILITY REDUCTION RATE (%) | DETERMI-NATION |
|---|---|---|---|---|---|---|
| | Da (mm) | Db (mm) | | Sa (mm) | | |
| #211 | 2.0 | 1.30 | 0.65 | 1.30 | 99.9 | ○ |
| #212 | 2.0 | 1.83 | 0.92 | 1.83 | 98.5 | ○ |
| #213 | 2.0 | 1.98 | 0.99 | 1.98 | 92.0 | ○ |
| #214 | 2.0 | 2.00 | 1.00 | 2.00 | 89.9 | △ |
| #215 | 2.0 | 2.05 | 1.03 | 2.05 | 88.9 | △ |

FIG. 22(A)
| No | GROUND ELECTRODE WIDTH Db (mm) | FLAT PORTION LENGTH Dc (mm) | GAP INCREASE (mm) | DETERMI-NATION |
|---|---|---|---|---|
| #221 | 1.3 | 0.41 | 0.23 | × |
| #222 | 1.3 | 0.57 | 0.18 | ○ |
| #223 | 1.3 | 0.75 | 0.15 | ○ |
| #231 | 2.0 | 0.41 | 0.21 | × |
| #232 | 2.0 | 0.57 | 0.16 | ○ |
| #233 | 2.0 | 0.75 | 0.12 | ○ |
FIG. 22 (B)
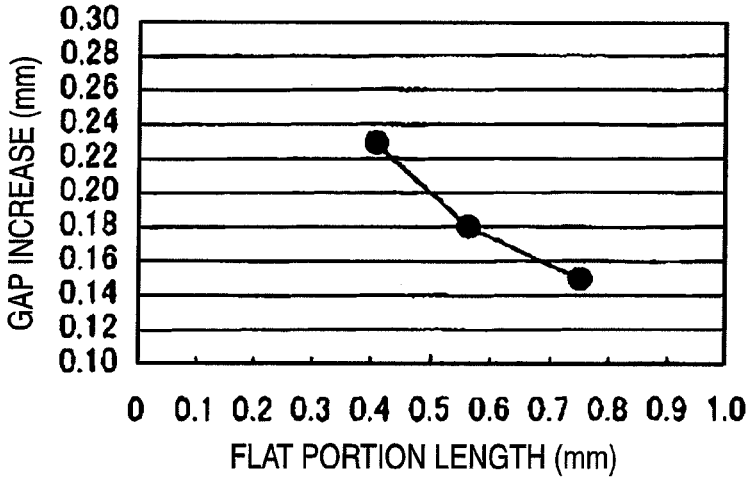
FIG. 22 (C)
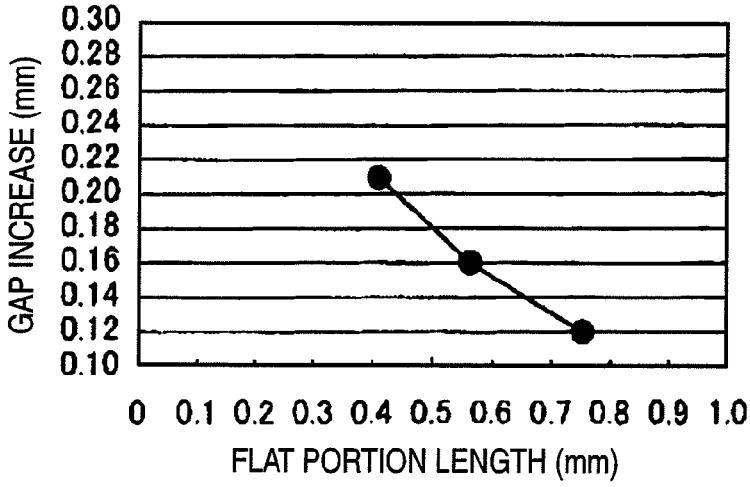

FIG. 23 (A)

| Ni (wt%) | Cr (wt%) | Si (wt%) | Al (wt%) | Mn (wt%) | Fe (wt%) | C (wt%) | Ti (wt%) |
|---|---|---|---|---|---|---|---|
| 61.54 | 22.1 | 0.3 | 1.2 | 0.6 | 14.1 | 0.06 | 0.1 |

FIG. 23 (B)

| No | Ni (wt%) | Cr (wt%) | Si (wt%) | Al (wt%) | Mn (wt%) | Nd (wt%) | C (wt%) | GAP INCREASE (mm) | DETERMI-NATION |
|---|---|---|---|---|---|---|---|---|---|
| #301 | 97.82 | 0.01 OR LESS | 0.7 | 1.0 | 0.2 | 0.25 | 0.03 | 0.17 | ○ |
| #302 | 97.52 | 0.01 OR LESS | 1.0 | 1.0 | 0.2 | 0.25 | 0.03 | 0.18 | ○ |
| #303 | 96.52 | 1.0 | 1.0 | 1.0 | 0.2 | 0.25 | 0.03 | 0.18 | ○ |
| #304 | 95.52 | 2.0 | 1.0 | 1.0 | 0.2 | 0.25 | 0.03 | 0.20 | × |

FIG. 24 (A)

| Ni (wt%) | Cr (wt%) | Si (wt%) | Al (wt%) | Mn (wt%) | Nd (wt%) | C (wt%) |
|---|---|---|---|---|---|---|
| 97.82 | 0.01 OR LESS | 0.7 | 1.0 | 0.2 | 0.25 | 0.03 |

FIG. 24 (B)

| No | Ni (wt%) | Cr (wt%) | Si (wt%) | Al (wt%) | Mn (wt%) | Fe (wt%) | C (wt%) | Ti (wt%) | GAP INCREASE (mm) | DETERMI-NATION |
|---|---|---|---|---|---|---|---|---|---|---|
| #311 | 81.26 | 10.5 | 0.2 | 0.2 | 0.3 | 7.2 | 0.04 | 0.3 | 0.21 | × |
| #312 | 76.76 | 15.0 | 0.2 | 0.2 | 0.3 | 7.2 | 0.04 | 0.3 | 0.19 | ○ |
| #313 | 61.54 | 22.1 | 0.3 | 1.2 | 0.6 | 14.1 | 0.06 | 0.1 | 0.17 | ○ |

SPARK PLUG HAVING A CENTER ELECTRODE AND A GROUND ELECTRODE PROVIDED WITH NO NOBLE METAL MEMBER

TECHNICAL FIELD

The present invention relates to a spark plug.

BACKGROUND ART

An improvement in ignitability is required for spark plugs in order to improve fuel consumption and reduce the amount of imperfect combustion gases. In the related spark plugs under such requirement, noble metals are used for a center electrode and a ground electrode. In addition, in these related spark plugs, that the ground electrode has a narrow width portion to improve the ignitability (for example, Patent Document 1).

However, it has generally been desired a technology to improve the ignitability without using any expensive noble metal materials.

RELATED ART DOCUMENT

Patent Document

Patent Document 1: JP-A-2007-250344

SUMMARY OF THE INVENTION

Problem that the Invention is to Solve

An object of the invention is to improve ignitability in a spark plug in which no noble metal is used for a center electrode and a ground electrode.

Means for Solving the Problem

With a view to attaining the object, according to an embodiment of the invention, a spark plug is configured as follows. Namely, there is provided a spark plug comprising a center electrode extending along an axial direction; an insulator provided on a periphery of the center electrode; a cylindrical metal shell surrounding the insulator in a radial direction; and a ground electrode including a discharge surface perpendicular or substantially perpendicular to the axial direction, and forming a spark gap defined between the discharge surface and a leading end of the center electrode, wherein the center electrode and the ground electrode are not provided with a noble metal member, when defining a downward direction as a direction of the axial direction directing from the center electrode to the discharge surface of the ground electrode, and defining an upward direction as a direction of the axial direction opposite to the downward direction, and the ground electrode comprises: a base portion combined with the metal shell and positioned at the upward direction side of the discharge surface; and a distal end portion including the discharge surface and positioned at the downward direction side of the base portion while continuing from the base portion, wherein when defining a first direction as a direction perpendicular to the axial direction and directing from the base portion to the center electrode, defining a width of the center electrode viewed from the first direction as Da, and defining a width of the base portion viewed from the first direction as Db, Da and Db satisfies $Db/Da \leqq 0.92$.

By adopting this configuration, when mounted in an engine, since a phenomenon that an air-fuel mixture is made difficult to reach the spark gap can be mitigated, the ignitability of the spark plug can be improved where no noble metal member is used for the center electrode and the ground electrode.

The spark plug described above can also be embodied as follows. For example, there is provided a spark plug comprising a center electrode extending along an axial direction; an insulator provided on a periphery of the center electrode; a cylindrical metal shell surrounding the insulator in a radial direction; and a ground electrode including a discharge surface perpendicular or substantially perpendicular to the axial direction, and forming a spark gap defined between the discharge surface and a leading end of the center electrode, wherein the center electrode and the ground electrode are not provided with a noble metal member, when defining a downward direction as a direction of the axial direction directing from the center electrode to the discharge surface of the ground electrode, and defining an upward direction as a direction of the axial direction opposite to the downward direction, and the ground electrode comprises: a base portion combined with the metal shell and positioned at the upward direction side of the discharge surface; and a distal end portion including the discharge surface and positioned at the downward direction side of the base portion while continuing from the base portion, wherein when defining a first direction as a direction perpendicular to the axial direction and directing from the base portion to the center electrode, defining a width of the center electrode viewed from the first direction as Da, and defining a width of the base portion viewed from the first direction as Db, Da and Db satisfies $Db/Da \leqq 0.99$, a plane of the distal end portion viewed from a direction opposite to the first direction has a shape whose four corners are chamfered with a curve or line, and a dimension of the chamfering is equal to or larger than 0.3 mm.

By adopting this configuration, since the flow of air-fuel mixture into the spark gap is promoted by the plane of the distal end portion being chamfered, the same advantage as that provided by the aforesaid spark plug can be obtained while maintaining the width of the ground electrode to a slightly larger value.

The spark plug described above can also be embodied as follows. For example, there is provided a spark plug comprising a center electrode extending along an axial direction; an insulator provided on a periphery of the center electrode; a cylindrical metal shell surrounding the insulator in a radial direction; and a ground electrode including a discharge surface perpendicular or substantially perpendicular to the axial direction, and forming a spark gap defined between the discharge surface and a leading end of the center electrode, wherein the center electrode and the ground electrode are not provided with a noble metal member, when defining a downward direction as a direction of the axial direction directing from the center electrode to the discharge surface of the ground electrode, and defining an upward direction as a direction of the axial direction opposite to the downward direction, and the ground electrode comprises: a base portion combined with the metal shell and positioned at the upward direction side of the discharge surface; and a distal end portion including the discharge surface and positioned at the downward direction side of the base portion while continuing from the base portion, wherein when defining a first direction as a direction perpendicular to the axial direction and directing from the base portion to the center electrode, defining a width of the center electrode viewed from the first direction as Da, and defining a width of the base portion viewed from the first direction as Db, Da and Db satisfies $Db/Da \leqq 0.99$, a plane of the distal end portion viewed from a direction opposite to the first direction has a shape obtained by cutting a circular shape with a line, and the discharge plane is a plane corresponds to a chord of the shape obtained by cutting the circular shape with a line.

By adopting this configuration, since the shape of the base portion becomes a substantially cylindrical shape, the air-fuel mixture is sent to a spark point smoothly. As a result of this, ignitability can be improved further while maintaining the width of the ground electrode to a larger value.

In the spark plug having the configuration described above, Db/Da≦0.92 may be satisfied.

By adopting this configuration, since the shape of the base portion becomes a substantially cylindrical shape, the air-fuel mixture is sent to a spark point smoothly. As a result of this, ignitability can be more improved.

In the spark plug having the configuration described above, a length of the chord of the shape obtained by cutting the circle with a line is equal to or longer than 0.57 mm By adopting this configuration, the same advantage as that obtained by the aforesaid spark plug can be obtained while ensuring the durability of the ground electrode.

In the spark plug having the configuration described above, the center electrode and the ground electrode are formed so that, when projecting the ground electrode onto the center electrode along the first direction, a shade of the ground electrode projected onto the center electrode is not formed on two shoulder portions of the distal end plane of the center electrode.

By adopting this configuration, since the spark plug has a tendency to discharge a spark between the two shoulder portions of the center electrode and the ground electrode, the air-fuel mixture is made easily reach the position of a spark generated by the discharge irrespective of the orientation of the ground electrode when the spark plug is mounted in an engine. As a result of this, ignitability can be improved.

In the spark plug having the configuration described above, a width of the distal end portion is equal to the width of the proximal end portion when viewed from the first direction.

By adopting this configuration, the same advantage as that obtained by the aforesaid spark plug can be obtained while ensuring ease with which the ground electrode is machined.

In the spark plug having the configuration described above, a cross section of the center electrode perpendicular to the axial direction is a circle whose diameter DD satisfies 1.3 mm≦DD≦2 mm.

In the spark plug having the configuration described above, the proximal end portion of the ground electrode and the distal end portion of the ground electrode have a same cross section area, and the cross section area is equal to or larger than 1 $mm^2$.

By adopting this configuration, the same advantage as that obtained by the aforesaid spark plug can be obtained while ensuring the durability of the ground electrode.

In the spark plug having the configuration described above, a thread diameter of a screw engaged with an engine head of the metal shell is equal to or smaller than M10.

In the spark plug having the configuration described above, the center electrode is a Ni alloy containing Ni equal to or more than 96.5 wt %.

By adopting this configuration, ignitability can be improved while ensuring the durability of the center electrode.

In the spark plug having the configuration described above, the ground electrode is a Ni alloy containing Cr equal to or more than 15 wt %.

By adopting this configuration, ignitability can be improved while ensuring the durability of the ground electrode.

BRIEF DESCRIPTION OF THE DRAWINGS

[FIG. 10(A), FIG. 10(B), FIG. 10(C), FIG. 10(D) and FIG. 10(E)] Drawings showing results of an ignitability evaluation test carried out by changing installing directions of the spark plug 100.

[FIG. 14(A), FIG. 14(B), FIG. 14(C), FIG. 14(D) and FIG. 14(E)] Drawings showing results of an ignitability evaluation test carried out by changing installing directions of the spark plug 100*a*.

[FIG. 22(A), FIG. 22(B) and FIG. 22(C)] Drawings showing results of a durability evaluation test carried out while changing lengths of a flat portion of the ground electrode.

[FIG. 23(A) and FIG. 23(B)] Drawings showing results of a durability evaluation test carried out while changing compositions of center electrode.

[FIG. 24(A) and FIG. 24(B)] Drawings showing results of a durability evaluation test carried out while changing compositions of the ground electrode.

DESCRIPTION OF EMBODIMENT

Next, embodiments and test results of the invention will be described in the following order.

A. Embodiments:

B. Test Result 1(Test Results with respect to Width of Ground Electrode)

C. Test Result 2(Test Results with respect to Chamfering Dimension of Ground Electrode)

D. Test Result 3 (Test Results with respect to Sectional Area of Ground electrode)

E. Test Result 4 (Test Results with respect to Width of Ground Electrode and Diameter of Ground Electrode)

F. Test Result 5 (Test Results with respect to Length of Flat portion of Ground Electrode)

G. Test Result 6 (Test Results with respect to Composition of Center Electrode)

H. Test Result 7 (Test Results with respect to Composition of Ground Electrode)

I. Modified Examples:

A. Embodiments

Figure 1:
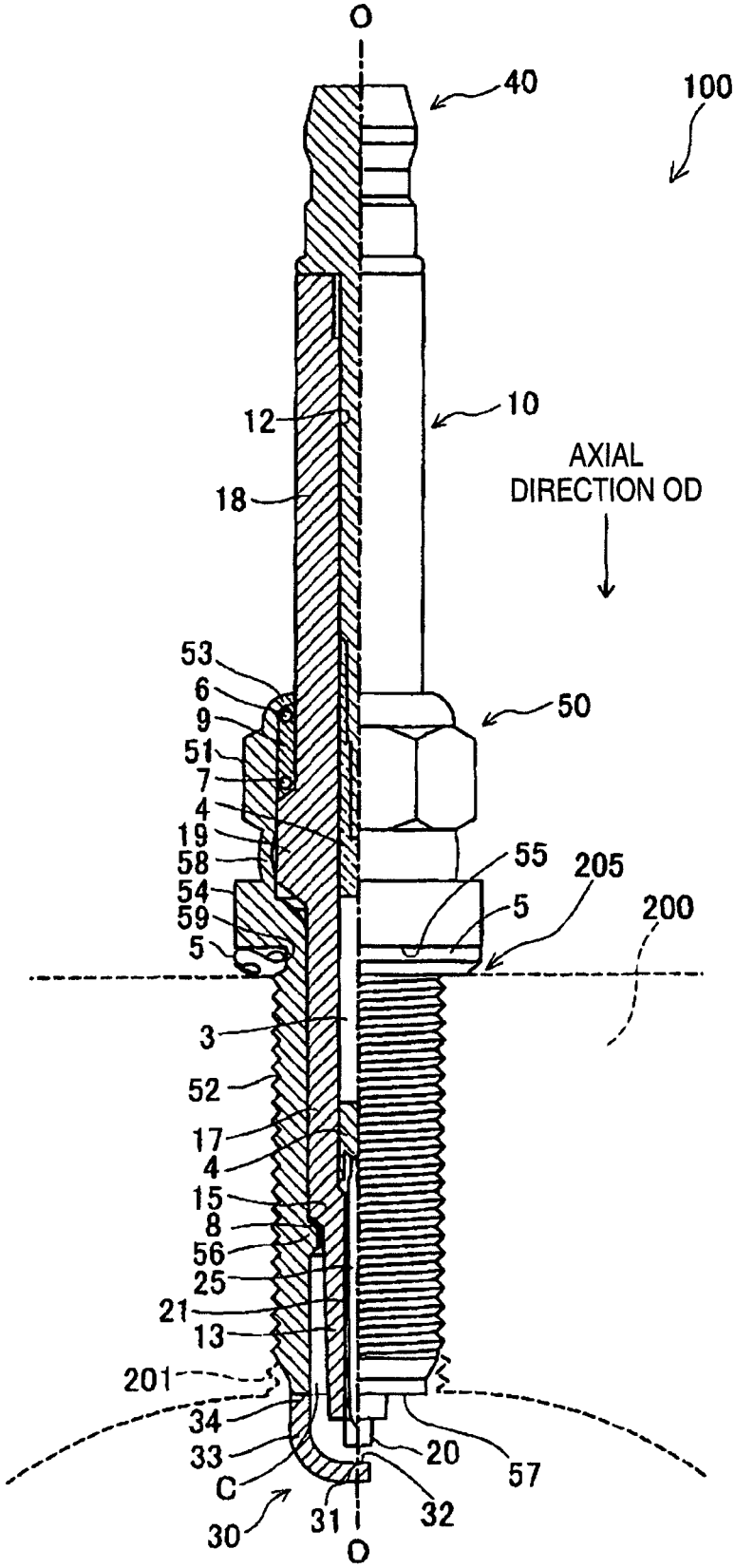
[FIG. 1] A partially sectional view of a spark plug 100 as one embodiment of the invention.

FIG. 1 is a partially sectional view of a spark plug 100 as one embodiment of the invention. Note that in FIG. 1, the spark plug 100 will be described based on the understanding that an axial direction OD of the spark plug 100 is referred to as a vertical direction in the drawing, a lower side of the drawing is referred to as a front side of the spark plug 100 and an upper side of the drawing is referred to as a rear end side thereof. The spark plug 100 includes an insulator 10 as an insulating body, a metal shell 50 which holds the insulator 10, a center electrode 20 which is held in the axial direction OD within the insulator 10, a ground electrode 30, and a plug cable terminal 40 which is provided at a rear end portion of the insulator 10.

The insulator 10 is, as is known, formed by calcining alumina or the like and has a cylindrical shape in which an axial hole 12 is formed in an axial center thereof so as to extend in the axial direction OD. A flange portion 19, which has a largest outside diameter, is formed substantially in a center along the axial direction OD, and a rear end side body portion 18 is formed further rearwards (further upwards in FIG. 1) towards a rear end side than the flange portion 19. A front end side body portion 17, whose outside diameter is smaller than the rear end side body portion 18, is formed further forwards (further downwards in FIG. 1) towards a distal end side than the flange portion 19. In addition, a nose portion 13, whose outside diameter is smaller than the front end side body portion 17, is formed further forwards towards the front end side than the front end side body portion 17. The nose portion 13 is reduced in diameter as it extends towards a front end side thereof and is exposed in a combustion chamber when the spark plug 100 is mounted in a cylinder head 200 of an internal combustion engine. A step portion 15 is formed between the nose portion 13 and the front end side body portion 17.

The metal shell 50 is a cylindrical fixture for fixing the spark plug 100 to the cylinder head 200 of the internal combustion engine. The metal shell 50 holds the insulator 10 in an interior thereof so as to surround a portion of the insulator 50 from part of the rear end side body portion 18 to the nose portion 13. The metal shell 50 is formed of a low carbon steel material and includes a tool engagement portion 51 on which a spark plug wrench, not shown, is fitted and a mounting screw thread portion 52 on which threads are formed so as to be screwed into a mounting screw hole 201 in the cylinder head 200 provided at an upper portion of the internal combustion engine. In first to fourth embodiments which will be described below, the mounting screw thread portion 52 preferably has an outside diameter (a screw thread diameter of screw threads which are brought into engagement with the cylinder head) which is M10 or less.

A flange-like seal portion 54 is formed between the tool engagement portion 51 and the mounting screw thread portion 52 of the metal shell 50. An annular gasket 5, which is formed by bending a plate material, is fittingly inserted in a screw neck 59 between the mounting screw thread portion 52 and the seal portion 54. The gasket 5 is collapsed forcibly between a bearing surface 55 of the seal portion 54 and a circumferential edge portion 205 of an opening in the mounting screw hole 201 to thereby be deformed when the spark plug 100 is mounted in the cylinder head 200. As a space between the spark plug 100 and the cylinder head 200 is sealed by the gasket 5 being so deformed, a gas leakage from an interior of the engine through the mounting screw hole 201 is prevented.

A thin crimping portion 53 is provided further rearwards towards the rear end side than the tool engagement portion 51 of the metal shell 50. In addition, a buckling portion 58, which is thin like the crimping portion 53, is provided between the seal portion 54 and the tool engagement portion 51. Annular ring members 6, 7 are interposed between an inner circumferential surface of the metal shell 50 which lies from the tool engagement portion 51 to the crimping portion 53 and an outer circumferential surface of the rear end side body portion 18 of the insulator 10, and powder of talc 9 is filled between both the ring members 6, 7. By crimping the crimping portion 53 so as to be bent inwards, the insulator 10 is pressed towards the front end side within the metal shell 50 via the ring members 6, 7 and the talc 9. By this action, the step portion 15 of the insulator 10 is supported on a step portion 56 which is formed on an inner circumference of the metal shell 50 in a position where the mounting screw thread portion 52 lies via an annular plate packing 8, whereby the metal shell 50 and the insulator 10 are integrated together. As this occurs, gastightness between the metal shell 50 and the insulator 10 is held by the plate packing 8, whereby combustion gases are prevented from flowing out of the engine. The buckling portion 58 is designed to deflect outwards to be deformed in association with application of a compression force when crimping is performed, and a compression length of the talc 9 in the axial direction OD is made long so as to increase the gastightness within the metal shell 50. A predetermined clearance is provided between the metal shell 50 and the insulator 10 at a portion which lies further forwards towards the front end side than the step portion 56.

The center electrode 20 is a rod-like electrode having a construction in which a core material 25, which is made of copper or an alloy containing copper as a principal composition which has superior thermal conductivity to that of an electrode base material 21, is embedded in an interior of the electrode base material 21, which is formed of nickel such as Inconel (trade name) 600 or 601 or an alloy containing nickel as a principal composition. Normally, the center electrode 20 is fabricated by placing the core material 25 in the interior of the electrode base material 21 which is formed into a bottomed cylindrical shape and extruding them from a bottom side into a long length of metal. Although the core material 25 has a substantially constant outside diameter in a body portion, a diameter reduced portion is formed at a front end side. The center electrode 20 is provided so as to extend towards the rear end side within the axial hole 12 and is electrically connected to the plug cable terminal 40 at the rear (at the top in FIG. 1) by way of a seal material 4 and a ceramic resistance 3 (FIG. 1). A high-tension cable (out of the figure) is connected to the plug cable terminal 40 via a plug cap (out of the figure) for a high voltage to be applied to the plug cable terminal 40.

Figure 2:
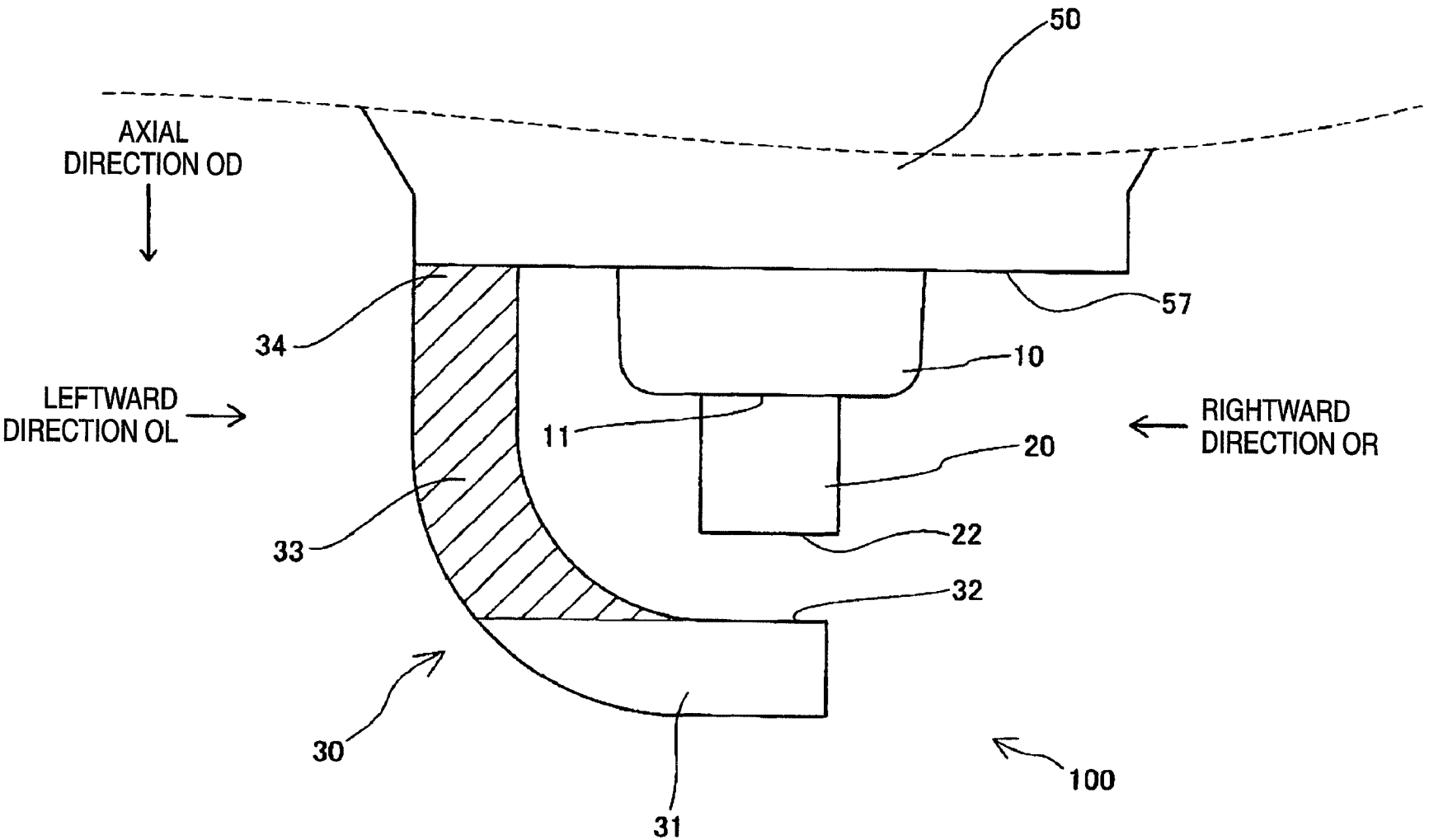
[FIG. 2] An enlarged view of a vicinity of a front end portion of a center electrode 20 of the spark plug 100 of the first embodiment.

FIG. 2 is an enlarged view of a vicinity of a front end portion of the center electrode 20 of the spark plug 100. As is shown in FIG. 2, a front end portion of the spark plug 100 includes the metal shell 50, the insulator 10, the center electrode 20 and the ground electrode 30. The insulator 10 projects from a front end face 57 of the metal shell 50. Similarly, the center electrode 20 projects from a front end face 11 of the insulator 10. This center electrode 20 preferably has a substantially circular cross section in a direction which intersects a longitudinal direction thereof at right angles (hereinafter, also referred to as a "cross section of the center electrode 20").

An electrode base material of the ground electrode 30 is made of a metal having a high corrosion resistance, and a nickel alloy is used as an example. In this embodiment, a nickel alloy called Inconel (Trade Mark) 600 (INC 600) is used. This ground electrode 30 has a substantially rectangular cross section in a direction which intersects a longitudinal direction thereof at right angles (hereinafter, also referred to as a "cross section of the ground electrode 30"). A proximal end portion (one end portion) of the ground electrode 30 is joined to the front end face 57 of the metal shell 50 by welding. The ground electrode is curved so that a discharge plane 32 which is one side surface of a distal end portion (the other end portion) 31 of the ground electrode 30 is curved so as to face a front end face 22 of the center electrode 20. In addition, a spark gap is formed between the discharge plane 32 and the front end face 22 of the center electrode 20. This spark gap can range approximately from 0.6 to 1.2 mm, for example. A portion of the ground electrode 30 which lies from the proximal end portion 34 to where the discharge plane 32 exists is referred to as a base portion 33 (hatched portion in FIG. 2). The compositions of the center electrode and the ground electrode are not limited to the nickel alloy described above, and hence, a Ni alloy may be used which contains as compositions, for example, about 0.7 wt % silicone (Si), about 1 wt % aluminum (Al), abut 0.2 wt % manganese (Mn), about 0.03 wt % carbon C, and about 0.2 wt % rare earth.

Figure 3:
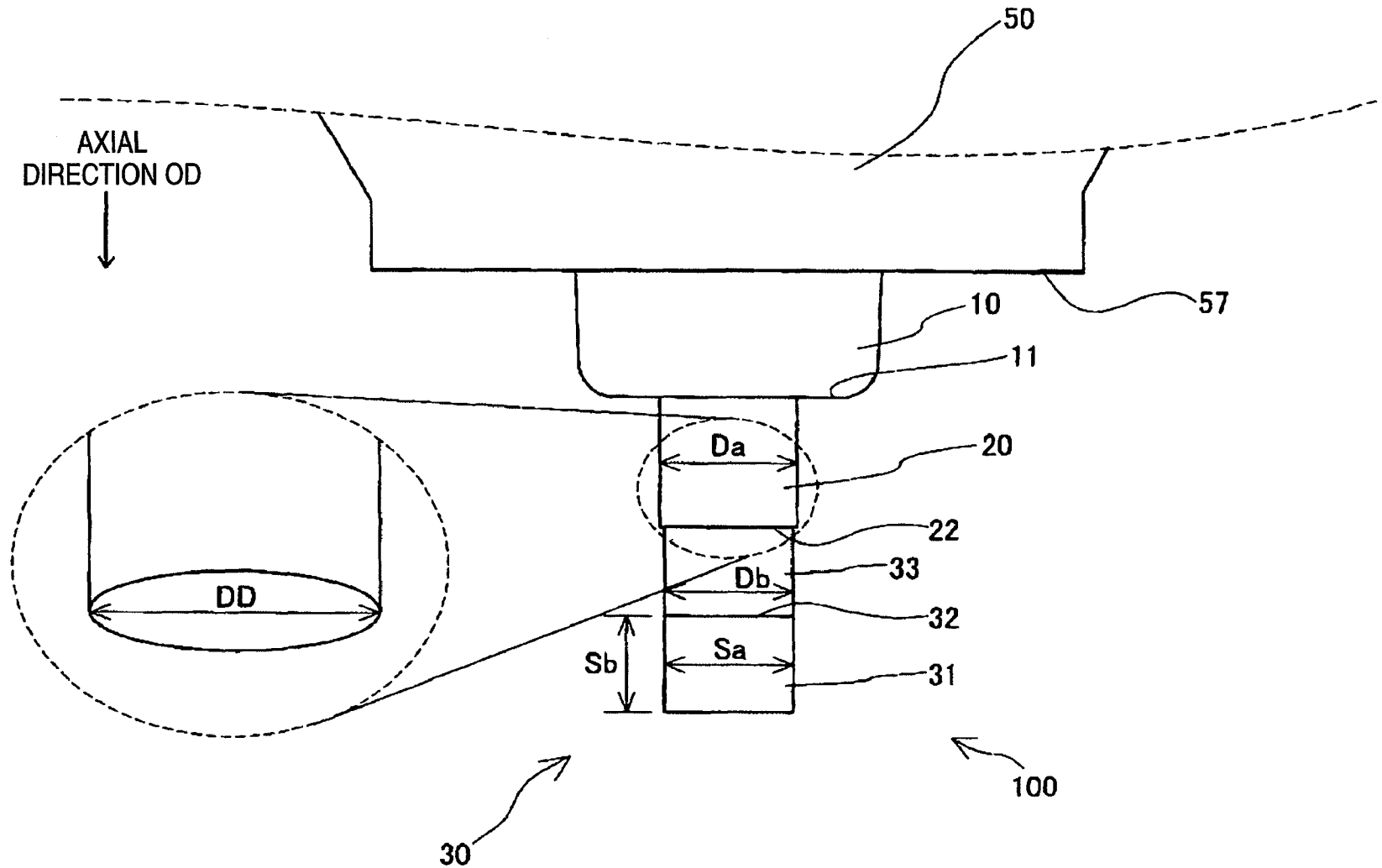
[FIG. 3] An enlarged view of the vicinity of the front end portion of the center electrode 20 of the spark plug 100 of the first embodiment when viewed from a rightward direction OR (FIG. 2).

FIG. 3 is an enlarged view of the vicinity of the front end portion of the center electrode 20 of the spark plug 100 of the first embodiment when viewed from a rightward direction OR (FIG. 2). Widths of i) the center electrode 20, ii) the base portion 33 and iii) the distal end portion 31 of the spark plug 100 are compared when the spark plug 100 is viewed in a direction which intersects the axial direction OD thereof at right angles and which connects the base portion 33 with the center electrode 20. A width Db of the base portion 33 (hereinafter, also referred to as a "ground electrode width Db") is the same as a width Sa of the distal end portion (Sa=Db). In addition, a width Da of the center electrode 20 (hereinafter, also referred to as a "center electrode width Da") is larger than the width Db of the base portion 33 (Db<Da). As this occurs, $Db/Da \leqq 0.99$ is preferably satisfied, and $Db/Da \leqq 0.92$ is more preferably satisfied. In this embodiment, a diameter DD of the front end face 22 of the center electrode 20 when viewed from an opposite direction to the axial direction OD of the spark plug 100 is preferably 1.3 mm or more and 2 mm or less. Further, a sectional area (Sa·Sb) of the ground electrode 30 in a direction which intersects a longitudinal direction thereof at right angles is preferably 1 $mm^2$ or more.

Figure 4:
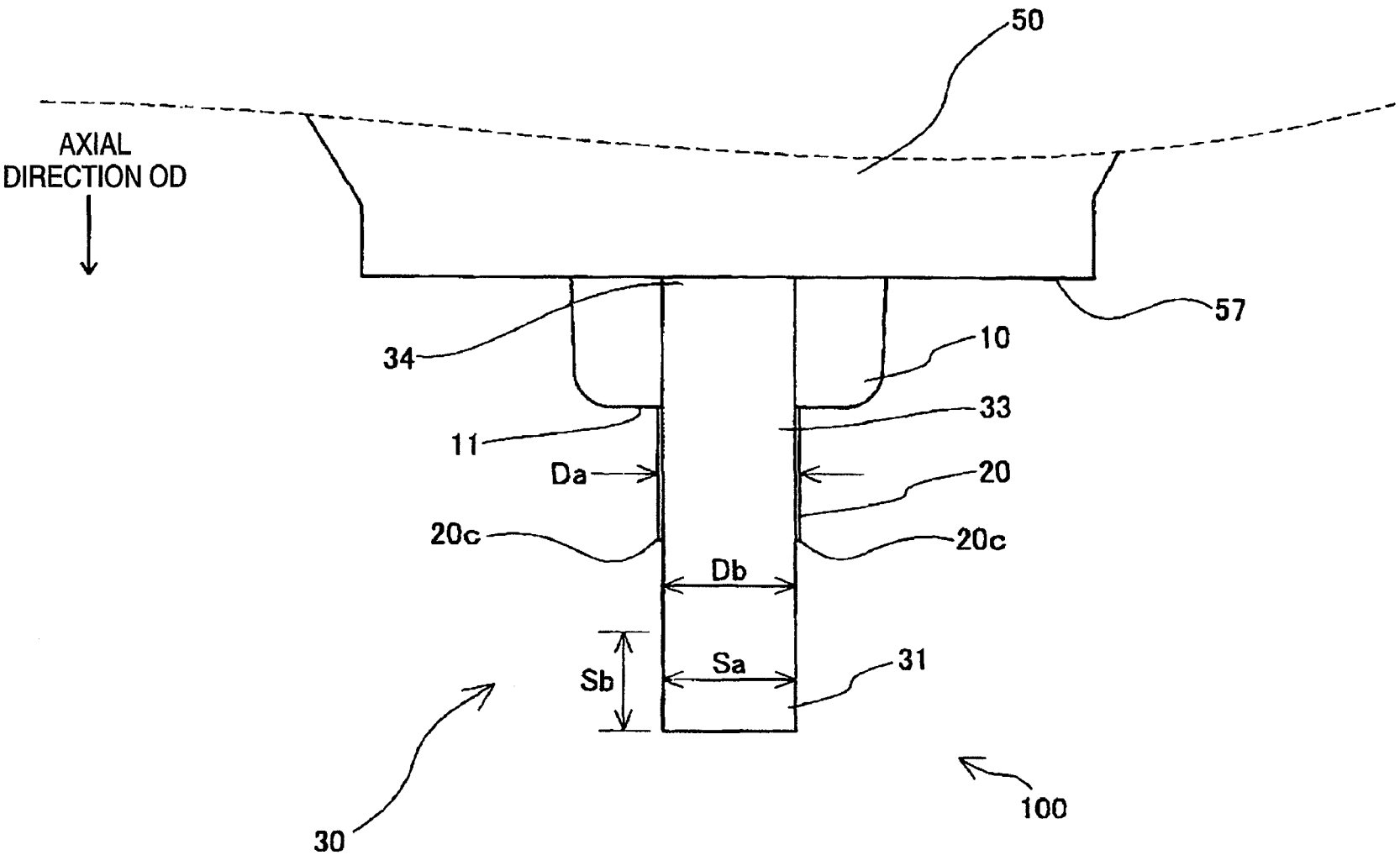
[FIG. 4] An enlarged view of the vicinity of the front end portion of the center electrode 20 of the spark plug 100 of the first embodiment when viewed from a leftward direction OL (FIG. 2).

FIG. 4 is an enlarged view of the vicinity of the front end portion of the center electrode 20 of the spark plug 100 of the first embodiment when viewed from a rightward direction OR (FIG. 2). A configuration is adopted in which two shoulder portions 20*c* of the front end face 22 of the center electrode 20 are both visible from both ends of the base portion 33 of the ground electrode 30 even when viewed from the leftward direction OL as is shown in FIG. 4. An advantage by this configuration is as follows.

An installation of the spark plug in a combustion chamber is implemented by screwing the mounting screw thread portion 52 of the spark plug 100 in the mounting screw hole 201 in the cylinder head 200. However, since directions of mounting screw holes 201 and mounting screw thread portions 52 vary product by product, orientations of spark plugs 100 which are installed in combustion chambers vary product by product. In contrast, positions of inlet valves and exhaust valves within combustion chamber are fixed. Consequently, depending upon the orientation of the ground electrode of the spark plug 100 within the combustion chamber, the ground electrode acts as a wall which interrupts a flow of air-fuel mixture into a spark point. In this way, the orientation of the ground electrode within the combustion chamber affects largely the ignition performance. In the spark plug 100 of the first embodiment, the two shoulder portions 20*c* of the center electrode 20 are visible from both the ends of the base portion 33 of the ground electrode 30 even when viewed from the leftward direction OL. Here, since a spark plug generally has a tendency to discharge a spark between an end portion of a center electrode and an end portion of a ground electrode, the frequency is high at which a lateral spark jump occurs at the two shoulder portions 20*c*, which are visible when viewed from the leftward direction OL, of a circumference of an end portion of the front end face of the center electrode. Consequently, even in a case where the spark plug 100 is mounted in such a direction that the ground electrode acts as a wall which makes it difficult for the air-fuel mixture to reach the spark gap, since the air-fuel mixture is allowed to reach easily the position where a spark is discharged, the ignitability of the spark plug can be improved.

Figure 5:
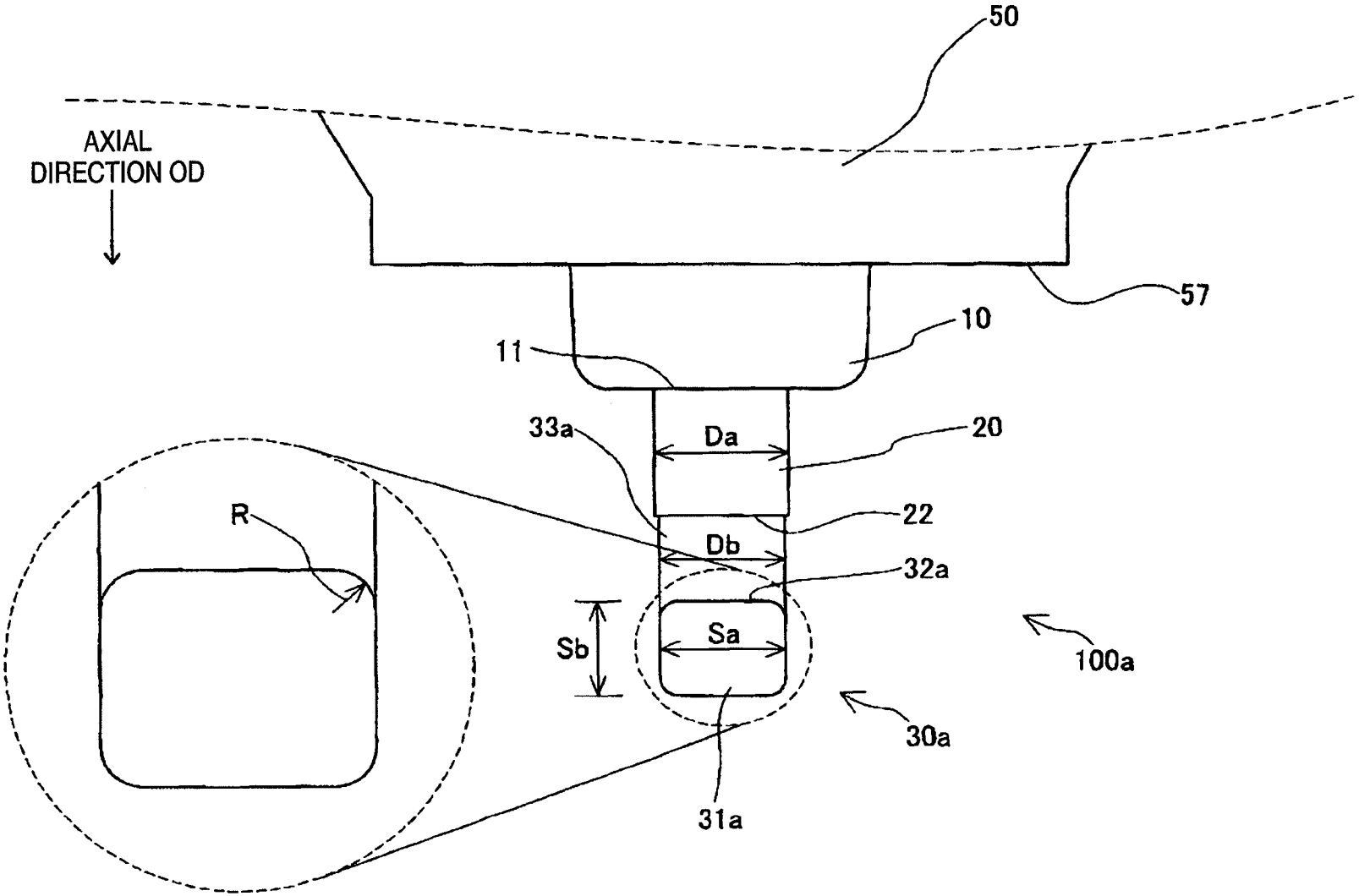
[FIG. 5] An enlarged view of a vicinity of a front end portion of a center electrode 20 of a spark plug 100*a* of a second embodiment when viewed from a rightward direction OR (FIG. 2).

FIG. 5 is an enlarged view of a portion of a center electrode 20 of a spark plug 100*a* of a second embodiment which lies in proximity to a front end thereof when viewed from a rightward direction OR (FIG. 2). A shape of a ground electrode 30*a* is only a difference from the spark plug 100 of the first embodiment. Specifically, the ground electrode 30*a* is curvilinearly chamfered at four corners as viewed in cross section (a so-called R-chamfering). A dimension of the R-chamfering (a radius of curvature R) is preferably 0.3 mm or more. In addition, the four corners of the cross section of the ground electrode 30*a* may be chamfered rectilinearly. A so-called C-chamfering is preferably implemented as the rectilinear chamfering. A chamfering dimension of the rectilinearly chamfered portion is also preferably 0.3 mm or more.

In this way, by giving the substantially elliptical shape to the cross section of the ground electrode 30*a*, the flow of air-fuel mixture into the spark gap is promoted. As a result of this, in addition to maintaining a sufficient thickness for the ground electrode, the ignitability of the spark plug 100 can be improved.

Figure 6:
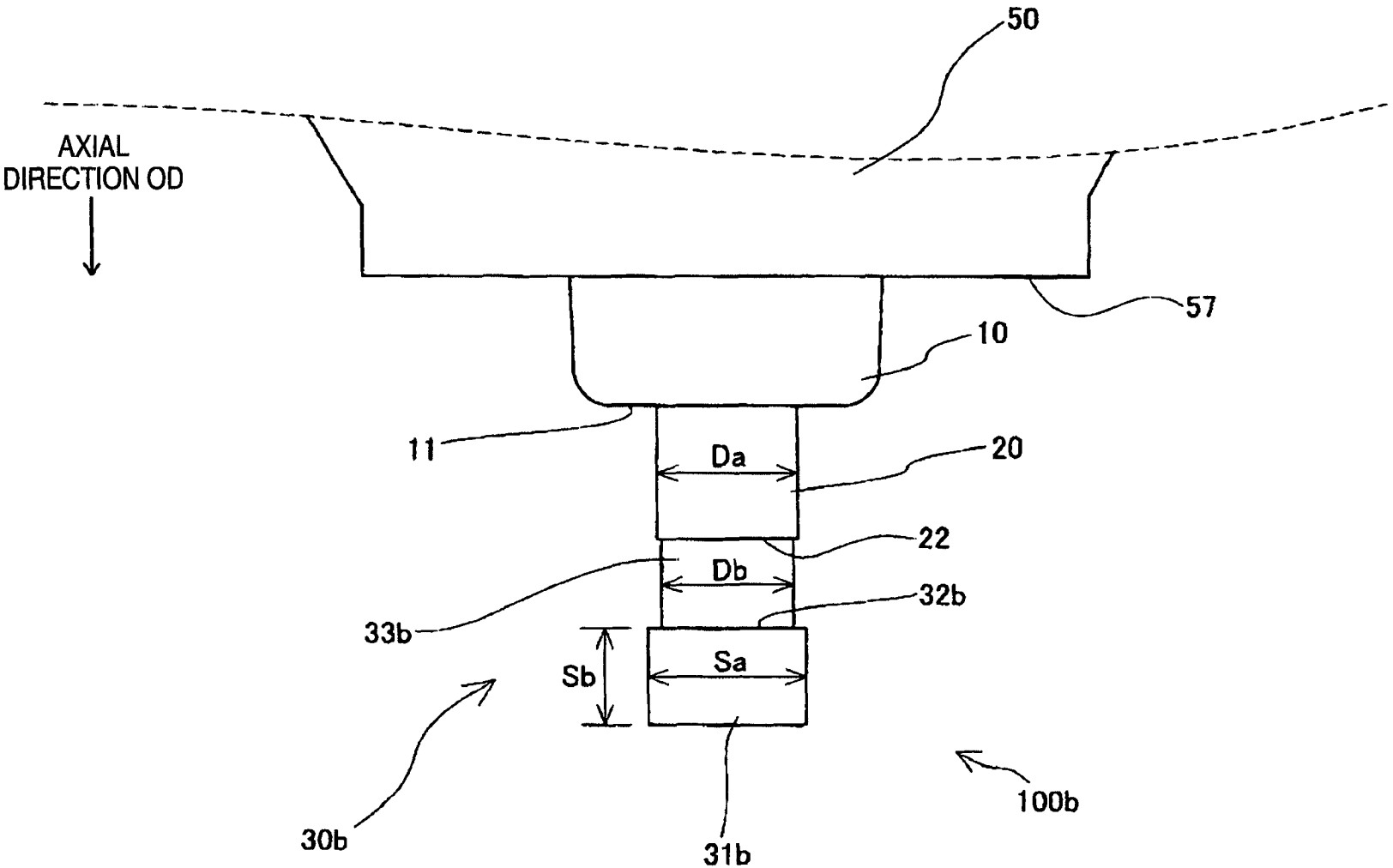
[FIG. 6] An enlarged view of a vicinity of a front end portion of a center electrode 20 of a spark plug 100*b* of a third embodiment when viewed from a rightward direction OR (FIG. 2).

FIG. 6 is an enlarged view of vicinity of a front end a portion of a center electrode 20 of a spark plug 100*b* of a third embodiment when viewed from a rightward direction OR (FIG. 2). The spark plug 100*b* differs from the spark plug 100 of the first embodiment only in that a width Sa of a distal end portion 31*b* is thick when the spark plug 100*b* is viewed in a direction which intersects an axial direction OD thereof at right angles and which connects a base portion 33*b* with a center electrode 20. In the third embodiment, the width Sa of the distal end portion 31*b*, a center electrode width Da and a ground electrode width Db satisfy a relationship expressed by the following expression.

Sa□Da>Db

In addition, widths of i) the center electrode 20 and ii) the base portion 33*b* of the spark plug 100*b* when the spark plug 100*b* is viewed in a direction which intersects the axial direction OD thereof at right angles and which connects the base portion 33*b* with the center electrode 20 are similar to those of the first embodiment and are as follows. Namely, Db/Da≦0.99 is preferably satisfied, and Db/Da≦0.92 is more preferably satisfied. In addition, in this embodiment, a diameter DD of a front end face 22 of the center electrode 20 when viewed from an opposite direction to the axial direction OD of the spark plug 100*b* (FIG. 3) is preferably 1.3 mm or more and 2 mm or less. Further, a sectional area (Sa·Sb) of the ground electrode 30*b* in a direction which intersects a longitudinal direction thereof at right angles is preferably 1 $mm^2$ or more.

Even with this configuration adopted, since even in the event that the spark plug 100*b* is mounted in such a direction that the ground electrode acts as a wall which makes it difficult for an air-fuel mixture to reach a spark gap as in the case of the first embodiment, the air-fuel mixture is allowed to easily reach a position where a spark is discharged, ignitability can be improved. In addition, by increasing the thickness of the distal end portion, an improvement in durability can be realized.

Figure 7:
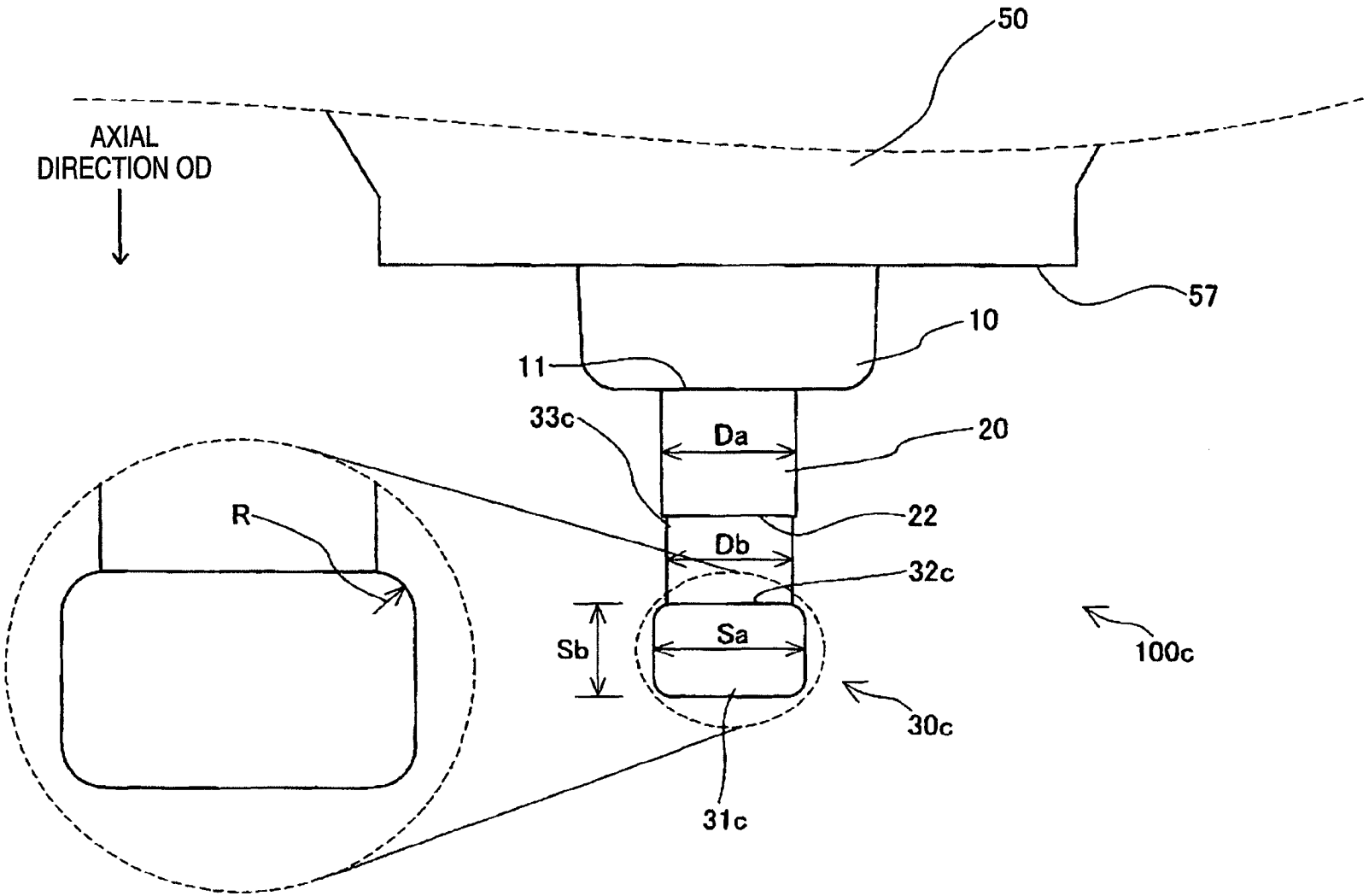
[FIG. 7] An enlarged view of a vicinity of a front end portion of a center electrode 20 of a spark plug 100*c* of a fourth embodiment when viewed from a rightward direction OR (FIG. 2).

FIG. 7 is an enlarged view of a vicinity of a front end portion of a center electrode 20 of a spark plug 100*c* of a fourth embodiment when viewed from a rightward direction OR (FIG. 2). The spark plug 100*c* differs from the spark plug 100*a* of the second embodiment only in that a width Sa of a distal end portion 31*c* is thick when the spark plug 100*c* is viewed in a direction which intersects an axial direction OD thereof at right angles and which connects a base portion 33*c* with a center electrode 20. In the fourth embodiment, a width Sa of the distal end portion 31*c*, a center electrode width Da and a ground electrode width Db satisfy a relationship expressed by the following expression.

Sa□Da>Db

In addition, widths of i) the center electrode 20 and ii) the base portion 33*c* of the spark plug 100*c* when the spark plug 100*c* is viewed in a direction which intersects the axial direction OD thereof at right angles and which connects the base portion 33*c* with the center electrode 20 are similar to those of the second embodiment and are as follows. Namely, Db/Da≦0.99 is preferably satisfied. In addition, in this embodiment, a diameter DD of a front end face 22 of the center electrode 20 when viewed from an opposite direction to the axial direction OD of the spark plug 100*b* (FIG. 3) is preferably 1.3 mm or more and 2 mm or less. Further, a sectional area (Sa·Sb) of the ground electrode 30*c* in a direction which intersects a longitudinal direction thereof at right angles is preferably 1 $mm^2$ or more.

Even with this configuration adopted, the flow of an air-fuel mixture into a spark gap is promoted as in the case of the second embodiment. As a result of this, in addition to maintaining the thickness of the ground electrode sufficiently, ignitability can be improved. In addition, by increasing the thickness of a distal end portion, an improvement in durability can be realized.

Figure 18:
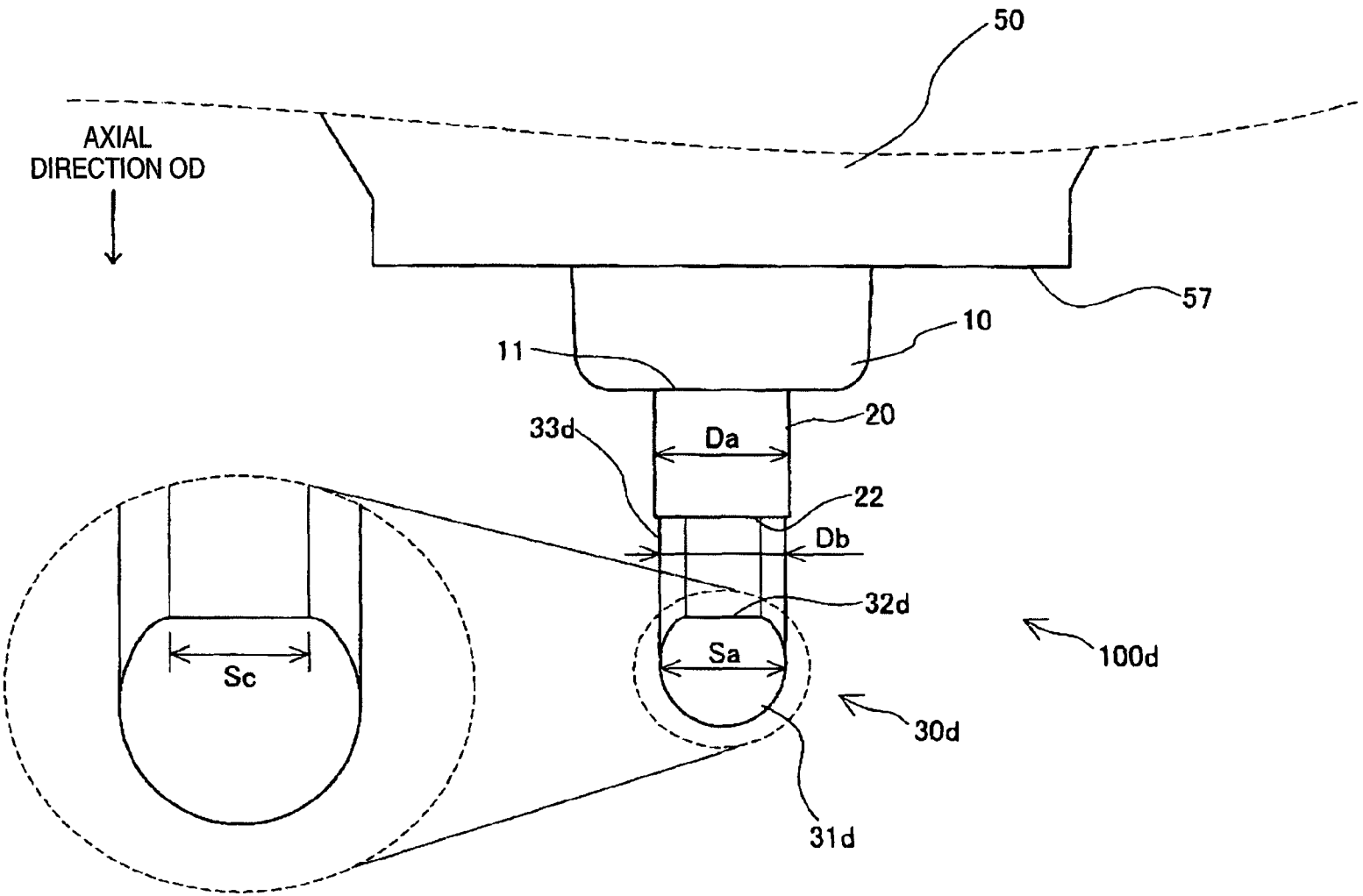
[FIG. 18] An enlarged view of a vicinity of a front end portion of a center electrode 20 of a spark plug 100*d* of a fifth embodiment when viewed from a rightward direction OR (FIG. 2).

FIG. 18 is an enlarged view of a vicinity of a front end portion of a center electrode 20 of a spark plug 100*d* of a fifth embodiment when viewed from a rightward direction OR (FIG. 2). A shape of a ground electrode 30*d* is only a difference from the spark plug 100 of the first embodiment. Specifically, the ground electrode 30*d* has a shape which results by cutting part of a substantially circular shape by a substantially straight line when viewed in cross section. Namely, the ground electrode 30*d* before it is bent is a substantially cylindrical member which is partially cut out in a longitudinal direction thereof. Further, in the ground electrode 30*d*, a plane which corresponds to a position of the shape cut by the straight line where a chord lies is joined to a metal shell 50 in an orientation in which the plane constitutes a discharge plane 32 after it is bent. In addition, the chord is also referred to as a "flat portion." Additionally, a length of the chord is also referred to as a "length Sc of the flat portion." The length of the flat portion Sc (hereinafter, also referred to as a "flat portion length Sc") is preferably 0.57 mm or more and is further preferably 0.75 or more. A configuration may be adopted in which of the ground electrode 30*d*, a portion which corresponds to a base portion 33*d* is not cut out but only a portion is cut out which constitutes the discharge plane 32*d* after bent.

Widths of i) the center electrode 20 and ii) the base portion 33*d* of the spark plug 100*d* when the spark plug 100*d* is viewed in a direction which intersects an axial direction OD thereof at right angles and which connects the base portion 33*d* with the center electrode 20 are similar to those of the first embodiment and are as follows. Namely, Db/Da≦0.99 is preferably satisfied, and Db/Da ≦0.92 is more preferably satisfied. In addition, in this embodiment, a diameter DD of a front end face 22 of the center electrode 20 when viewed from an opposite direction to the axial direction OD of the spark plug 100*d* (FIG. 3) is preferably 1.3 mm or more and 2 mm or less. Further, a sectional area of the ground electrode 30*d* in a direction which intersects a longitudinal direction thereof at right angles is preferably 1 $mm^2$ or more.

In this way, by adopting the shape which is obtained by cutting part of the substantially circular shape in the cross section of the ground electrode, the flow of an air-fuel mixture into a spark gap is more promoted. Specifically, in the fifth embodiment, since the shape of the base portion becomes the substantially circular shape, the air-fuel mixture is smoothly sent to a spark point. As a result of this, in addition to maintaining the thickness of the ground electrode sufficiently, ignitability can be improved.

Figure 19:
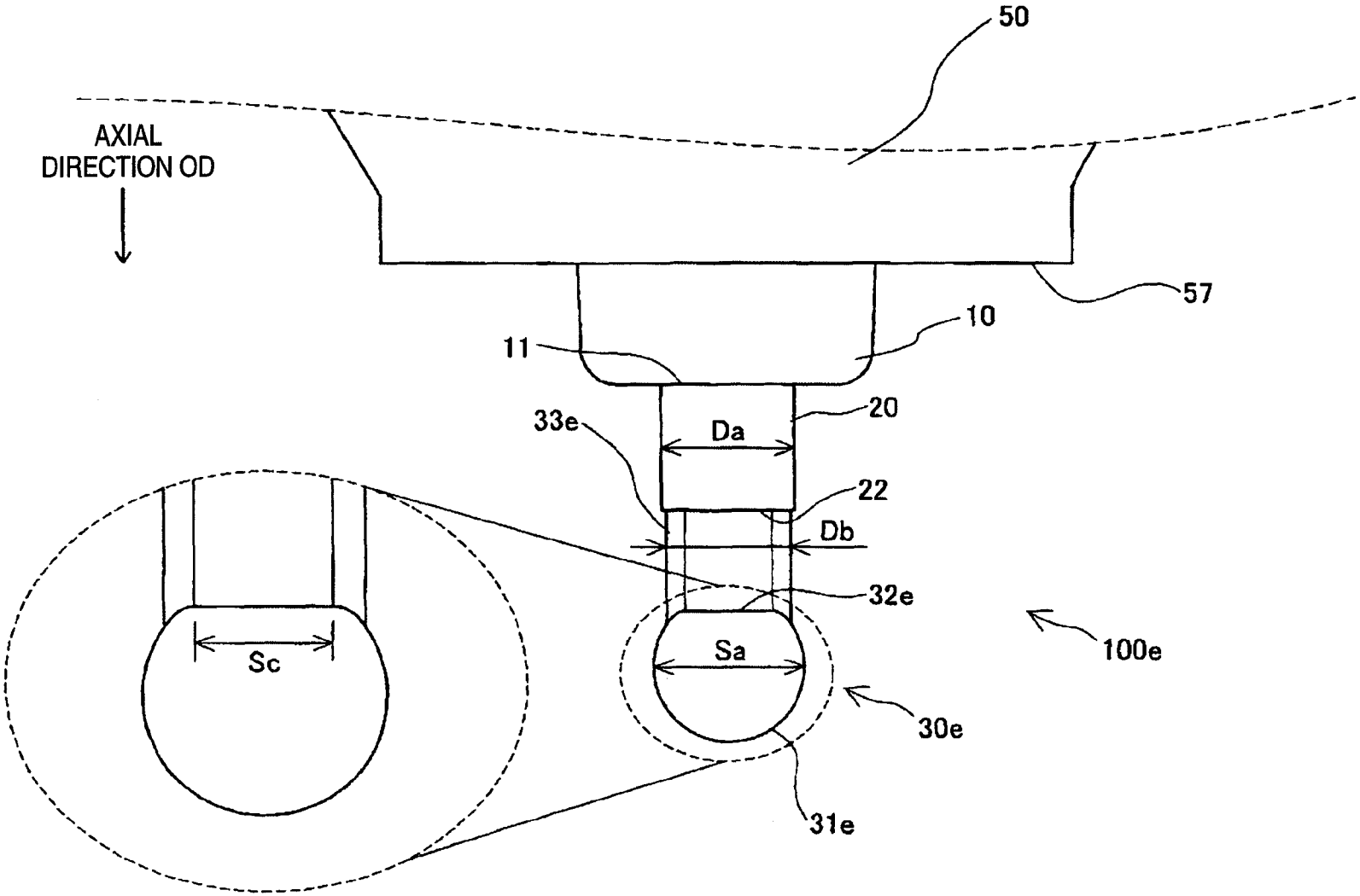
[FIG. 19] An enlarged view of a vicinity of a front end portion of a center electrode 20 of a spark plug 100*e* of a sixth embodiment when viewed from a rightward direction OR (FIG. 2).

FIG. 19 is an enlarged view of a vicinity of a front end portion of a center electrode 20 of a spark plug 100*e* of a sixth embodiment when viewed from a rightward direction OR (FIG. 2). The spark plug 100*e* differs from the spark plug 100*d* of the fifth embodiment only in that a width Sa of a distal end portion 31*e* is thick when the spark plug 100*e* is viewed in a direction which intersects an axial direction OD thereof at right angles and which connects a base portion 33*e* with a center electrode 20. In the fifth embodiment, the width Sa of the distal end portion 31*e*, a center electrode width Da and a ground electrode width Db satisfy a relationship expressed by the following expression.

Sa□Da>Db

Widths of i) the center electrode 20 and ii) the base portion 33*e* of the spark plug 100*e* when the spark plug 100*e* is viewed in a direction which intersects an axial direction OD thereof at right angles and which connects the base portion 33*e* with the center electrode 20 are similar to those of the fifth embodiment and are as follows. Namely, Db/Da≦0.99 is preferably satisfied, and Db/Da≦0.92 is more preferably satisfied. In addition, in this embodiment, a diameter DD of a front end face 22 of the center electrode 20 when viewed from an opposite direction to the axial direction OD of the spark plug 100*e* (FIG. 3) is preferably 1.3 mm or more and 2 mm or less. Further, a sectional area of the ground electrode 30*e* in a direction which intersects a longitudinal direction thereof at right angles is preferably 1 $mm^2$ or more.

Even with this configuration adopted, since the shape of the base portion becomes a substantially circular shape as in the case of the fifth embodiment, the flow of an air-fuel mixture into a spark gap is more promoted. As a result of this, in addition to maintaining the thickness of the ground electrode sufficiently, ignitability can be improved. In addition, by increasing the thickness of the distal end portion, an improvement in durability can be realized.

B. Test Result 1 (Test Results with Respect to Ground Electrode Width)

Figure 8:
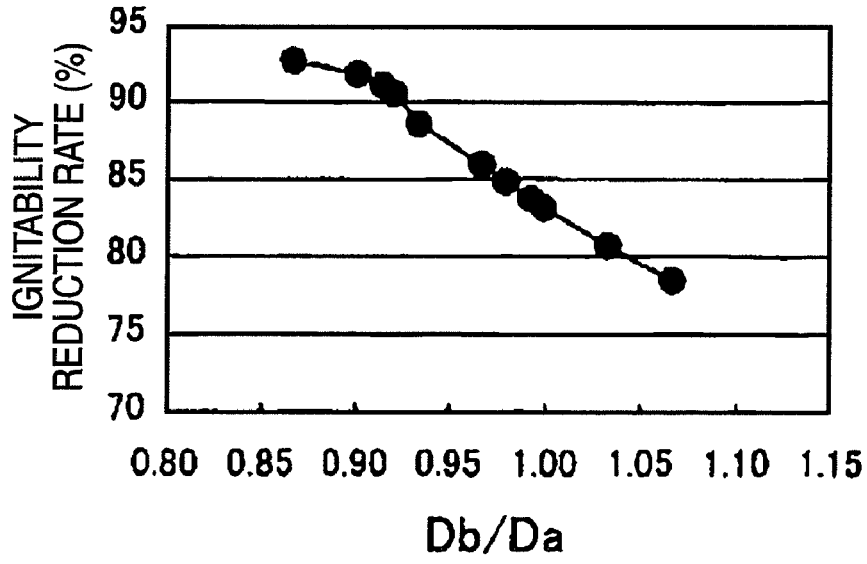
[FIG. 8(A) and FIG. 8(B)] Drawings showing results of an ignitability evaluation test with respect to a width of a ground electrode of the spark plug 100.
Figure 9:
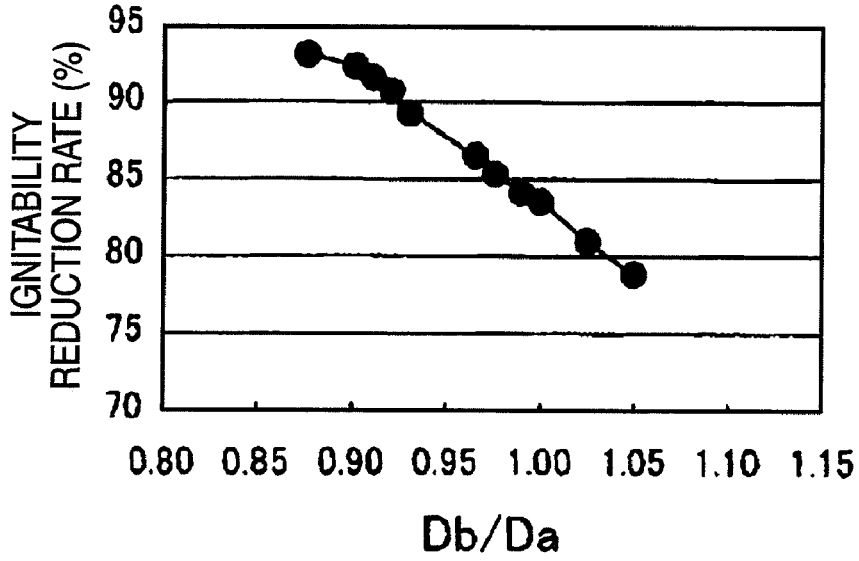
[FIG. 9(A) and FIG. 9(B)] Drawings showing results of another ignitability evaluation test with respect to the width of the ground electrode of the spark plug 100.
Figure 11:
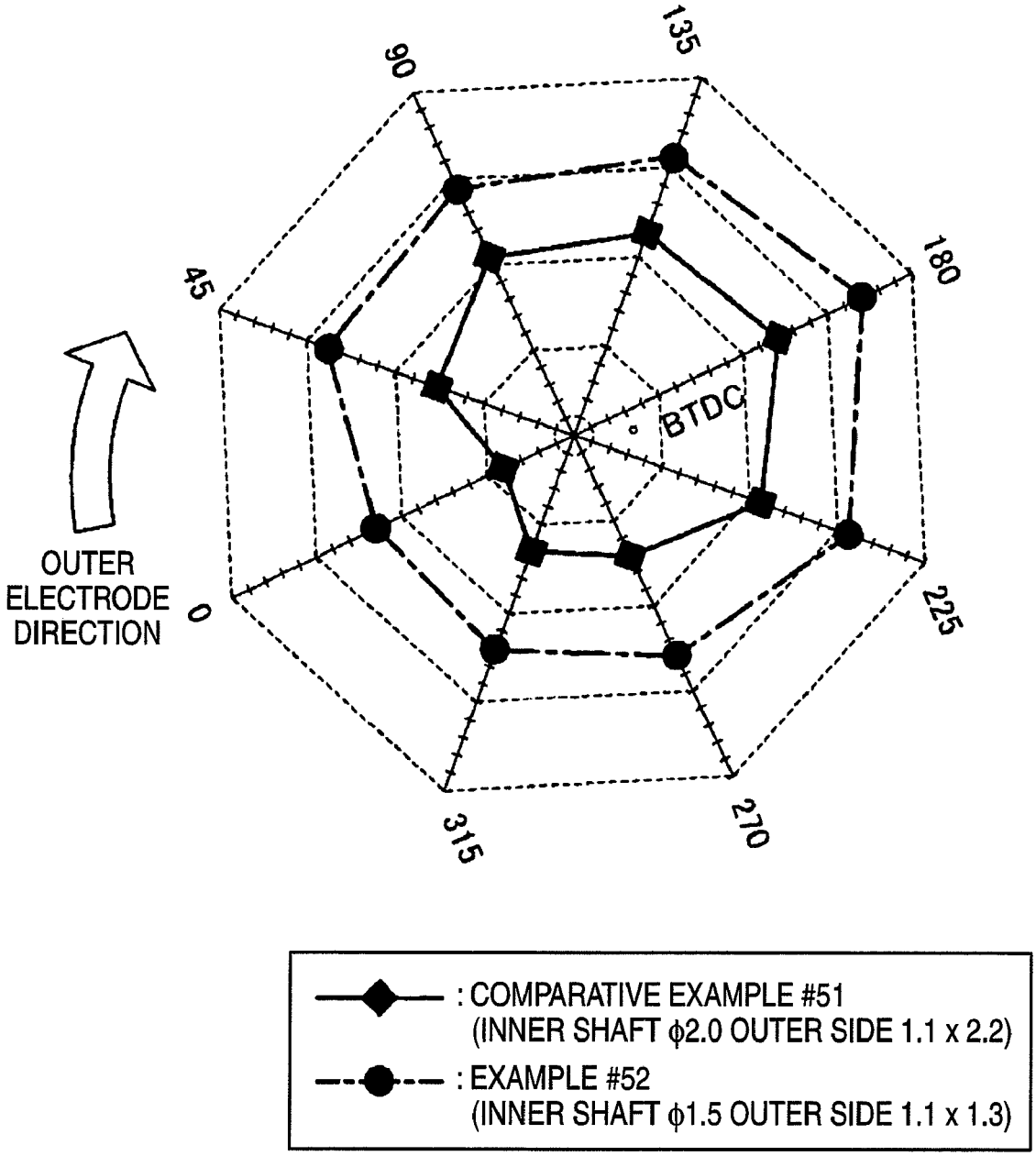
[FIG. 11] Drawings showing results of another ignitability evaluation test carried out by changing installing directions of the spark plug 100.

FIG. 8 shows drawings showing results of an ignitability evaluation test with respect to the ground electrode width of the spark plug 100. In addition, FIG. 9 shows drawings showing results of another ignitability evaluation test with respect to the ground electrode width of the spark plug 100. In these ignitability tests, spark plugs were mounted in a six-cylinder DOHC gasoline engine with a displacement of 2000 cc and the engine was caused to run idle at 750 rpm with an intake pressure of −550 mmHg. The ignition timing of the spark plugs was advanced to measure an ignition timing at which no misfire occurred (hereinafter, referred to as a "stable combustion limit advance angle"). The sample spark plugs used then were spark plugs 100 described in the first embodiment. Further, in those spark plugs, a projecting dimension of the insulator 10 from the front end face 57 of the metal shell 50 was 1.5 mm and a projecting dimension of the center electrode 20 from the front end face 11 of the insulator 10 was 1.5 mm.

FIG. 8A shows test results of samples No. 1 to No. 11 in which the center electrode width Da (FIG. 3) was fixed to 1.5 mm. FIG. 9A shows test results of samples No. 21 to 31 in which the center electrode width Da (FIG. 3) was fixed to 2.0 mm. Stable combustion limit advance angles (·BTDC) were obtained for those samples while changing the ground electrode width Db (FIG. 3), and those shown in percentage denote "ignitability reduction rates (%)." These ignitability reduction rates were obtained by the following expression.

Ignitability reduction rate (%)=[stable combustion limit advance angle (·BTDC) in a direction in which ignitability deteriorates]/[stable combustion limit advance angle (·BTDC) in a direction in which ignitability improves]

In this evaluation, from the reason that ignitability varies slightly depending upon the orientation of the ground electrode within the combustion chamber, samples whose ignitability reduction rates were about 85% to 90% were "determined" as □ and samples whose ignitability reduction rates were less than 85% were "determined" as x. FIG. 8B is a graph showing results of the evaluation in FIG. 8A. Similarly, FIG. 9B is a graph showing results of the evaluation in FIG. 9A.

It is seen from the results of the evaluation tests that the ignitability is improved more as the ratio (Db/Da) of the ground electrode width Db to the center electrode width Da becomes smaller. This is because the smaller the ground electrode width Db, the more visible the center electrode 20, even when the spark plug 100 is viewed from the orientation shown in FIG. 4. It is seen from what has been described above that it is preferable that the relationship expressed by Db/Da≦0.92 is satisfied.

FIG. 10 shows drawings showing results of an ignitability evaluation test carried out by changing installing directions of the spark plug 100. A method used in this ignitability evaluation test is similar to the evaluation tests shown in FIGS. 8 and 9 and in this method, spark plugs were mounted in a six-cylinder DOHC gasoline engine with a displacement of 2000 cc and the engine was caused to run idle at 750 rpm with an intake pressure of −550 mmHg. The ignition timing of the spark plugs was advanced to measure an ignition timing at which no misfire was generated (hereinafter, referred to as a "stable combustion limit advance angle"). The sample spark plugs used then were spark plugs 100 described in the first embodiment. Further, in those spark plugs, a projecting dimension of the insulator 10 from the front end face 57 of the metal shell 50 was 1.5 mm and a projecting dimension of the center electrode 20 from the front end face 11 of the insulator 10 was 1.5 mm.

FIG. 10A shows spark plugs used in the evaluation test. In this evaluation, a spark plug was used as a comparative example No. 41 in which the center electrode width Da was 1.5 mm and the ground electrode width Db was 1.7 mm. A spark plug which was similar to the sample No. 1 shown in FIG. 8A was used as an example No. 42.

FIGS. 10B and 10C show installing directions of the spark plugs in this evaluation. FIG. 10B shows a drawing showing a case in which the spark plug 100 is installed so that a distal end portion 31 of a ground electrode thereof is oriented towards a side where exhaust valves are installed. FIG. 10C shows a drawing showing a case in which the spark plug 100 is installed so that the distal end portion 31 of the ground electrode thereof is oriented towards a side where inlet valves are installed. In this engine, there is a flow RR of air-fuel mixture from the inlet valve side (hereinafter, also referred to as an "IN side") to the exhaust valve side (hereinafter, also referred to as an "EX side"). Because of this, when the spark plug 100 is installed in the orientation shown in FIG. 10B, the ignition performance becomes lowest, while when the spark plug 100 is installed in the orientation shown in FIG. 10C, the ignition performance becomes highest. Note that the arrangement of the valves and the flow RR of air-fuel mixture in FIGS. 10B, 10C, are shown with the configuration of the engine simplified to an extreme extent. In general, since the flow of air-fuel mixture within the combustion chamber is affected by various factors including the shape of an inlet pipe and the construction of a combustion chamber, the flow of air-fuel mixture is not such as to be determined solely based on the positions of the valves.

FIG. 10D is a graph showing stable combustion limit advance angles (·BTDC) and ignitability reduction rate which were obtained when the evaluation test was carried out on each of the comparative example No. 41 and the example No. 42 with the spark plugs installed on the IN side (FIG. 10B) and on the EX side (FIG. 10C). This ignitability reduction rate was obtained by the following expression.

Ignitability reduction rate (%)=[stable combustion limit advance angle (·BTDC) in a direction in which ignitability deteriorates]/[stable combustion limit advance angle (·BTDC) in a direction in which ignitability improves]

FIG. 10E is a graph showing results of the evaluation test. It is seen from the results of the evaluation test that compared with the comparative example No. 41, in the spark plug of the example No. 42, the stable combustion limit advance angle (·BTDC) when the spark plug is installed in the direction in which the ignitability deteriorates is improved largely. In addition, a spark plug similar to the sample No. 1 shown in FIG. 8A was used for an example No. 52. Then, stable combustion limit advance angles (·BTDC) were measured both on a comparative example No. 51 and the example No. 52 by shifting clockwise the installing directions of the spark plugs through 45 degrees each time from where the spark plugs were installed so that distal end portions 31 of ground electrodes thereof were oriented towards the exhaust valve side (FIG. 9B), with this condition regarded as 0 degree. Namely, a portion corresponding to 0 degree denotes a stable combustion limit advance angle (·BTDC) when the spark plugs were installed in the direction in which the ignitability deteriorates worst. In addition, a portion corresponding to 180 degrees denotes a stable combustion limit advance angle (·BTDC) when the spark plugs were installed in the direction in which the ignitability improves best. It is also seen from the results of the evaluation test that compared with the comparative example No. 51, in the example No. 52, the stable combustion limit advance angle a stable combustion limit advance angle (·BTDC) is improved largely. In addition, it is seen that the variation in ignition performance is suppressed between where the spark plugs were installed in the direction in which ignitability improves and where the spark plugs were installed in the direction in which ignitability deteriorates.

C. Test Result 2 ( Test Results with Respect to Ground Electrode Width and Chamfering Dimension)

Figure 12:
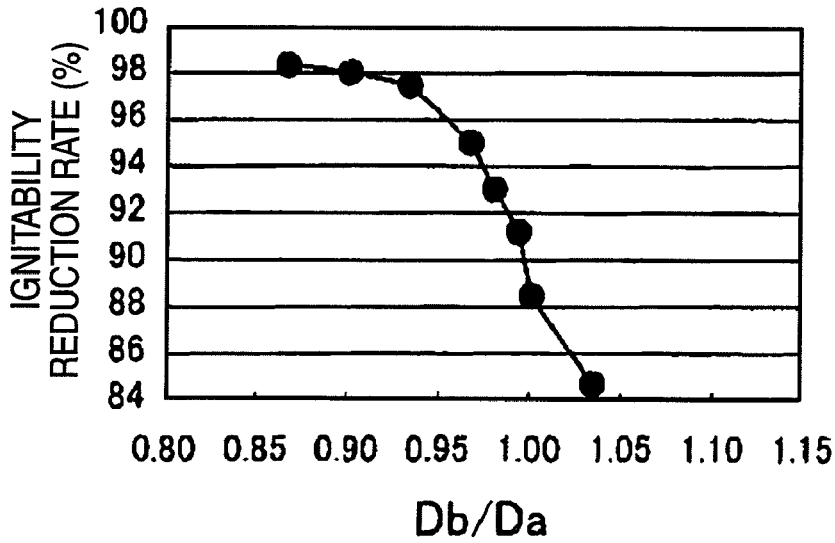
[FIG. 12(A) and FIG. 12(B)] Drawings showing results of an ignitability evaluation test with respect to a width of a ground electrode of the spark plug 100*a*.
Figure 13:
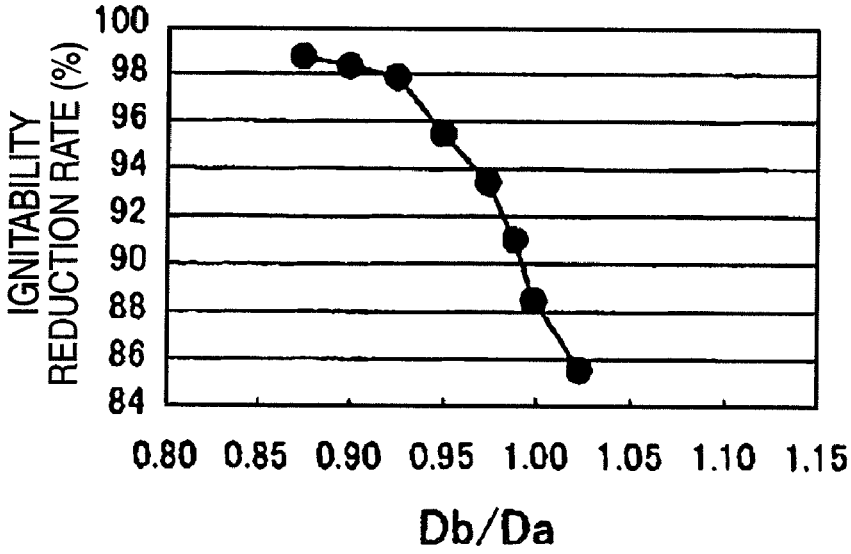
[FIG. 13(A) and FIG. 13(B)] Drawings showing results of another ignitability evaluation test with respect to the width of the ground electrode of the spark plug 100*a*.

FIG. 12 shows drawings showing results of an ignitability evaluation test with respect to the ground electrode width of the spark plug 100*a*. In addition, FIG. 13 shows drawings showing results of another ignitability evaluation test with respect to the ground electrode width of the spark plug 100*a*. These ignitability evaluation tests were carried out to the method described in FIGS. 8 and 9. Spark plugs used then were spark plugs 100*a* described above as the second embodiment. Further, in those spark plugs, a projecting dimension of the insulator 10 from the front end face 57 of the metal shell 50 was 1.5 mm and a projecting dimension of the center electrode 20 from the front end face 11 of the insulator 10 was 1.5 mm.

FIG. 12A shows test results on sample Nos. 71 to 78 in which the center electrode width Da (FIG. 5) was fixed to 1.5 mm and the chamfering dimension R of the ground electrode (FIG. 5) was fixed to 0.3 mm. In these samples, the R-chamfering was adopted as a chamfering shape. FIG. 13A shows test results on sample Nos. 81 to 88 in which the center electrode width Da (FIG. 5) was fixed to 2.0 mm and the chamfering dimension R of the ground electrode (FIG. 5) was fixed to 0.3 mm. Stable combustion limit advance angles (·BTDC) were obtained for the samples while changing the ground electrode width Db (FIG. 5), and measured results shown in percentage were "ignitability reduction rates (%)." A calculation method of ignitability reduction rates is similar to that described in FIG. 8.

In this evaluation, too, similarly to FIGS. 8 and 9, from the reason that ignitability varies slightly depending upon the orientation of the ground electrode within the combustion chamber, samples whose ignitability reduction rates were about 85% to 90% were "determined" as □ and samples whose ignitability reduction rates were less than 85% were "determined" as x. FIG. 12B is a graph showing results of the evaluation in FIG. 12A. Similarly, FIG. 13B is a graph showing results of the evaluation in FIG. 13A.

It is seen from the results of the evaluation tests that the ignitability is improved more as the ratio (Db/Da) of the ground electrode width Db to the center electrode width Da becomes smaller. Further, with the spark plug 100*a* of the second embodiment, it is seen that even when the ratio (Db/Da) of the ground electrode width to the center electrode width Da is relatively high, the ignition performance can be ensured. This is because the flow of air-fuel mixture into the spark gap is promoted due to the four corners of the ground electrode 30*a* being chamfered. It is seen from what has been described above that in the spark plug 100*a* of the second embodiment, it is preferable to satisfy the relationship expressed by Db, Db/Da≦0.99.

FIG. 14 shows drawings showing results of an ignitability evaluation test carried out by changing installing directions of the spark plug 100*a*. This ignitability evaluation test was carried out to the method described in FIG. 10. In addition, spark plugs used then were spark plugs 100*a* described as the second embodiment. Further, in those spark plugs, a projecting dimension of the insulator 10 from the front end face 57 of the metal shell 50 was 1.5 mm and a projecting dimension of the center electrode 20 from the front end face 11 of the insulator 10 was 1.5 mm.

FIG. 14A shows the spark plugs used in this evaluation. In this evaluation, as a comparative example No. 91, a spark plug was used in which the center electrode width Da was 1.5 mm and the ground electrode width Db was 1.7 mm. As an example No. 92, a spark plug was used which was similar to the sample No. 71 in FIG. 12A. Similarly to FIG. 10, FIGS. 14B and 14C show the flow of air-fuel mixture in an engine used in this evaluation. FIG. 14D is a graph showing stable combustion limit advance angles (·BTDC) and ignitability reduction rates when the evaluation test was carried out on each of the comparative example No. 91 and the example No. 92 with the installing direction of the spark plug oriented to an IN side (FIG. 14B) and an EX side (FIG. 14C). A calculation method of ignitability reduction rate is similar to that described in FIG. 10.

FIG. 14E is a graph showing the results of the evaluation test. It is seen from the results of the evaluation test that the stable combustion limit advance angle (·BTDC) of the example No. 92 which was measured with the spark plug installed in the direction in which ignitability deteriorates is larger than the stable combustion limit advance angle (·BTDC) of the comparative example No. 91 which was measured with the spark plug installed in the direction in which ignitability improves. This indicates that the spark plug of the example No. 92 has a better ignition performance than that of the comparative example No. 91, irrespective of the installing direction thereof.

Figure 15:
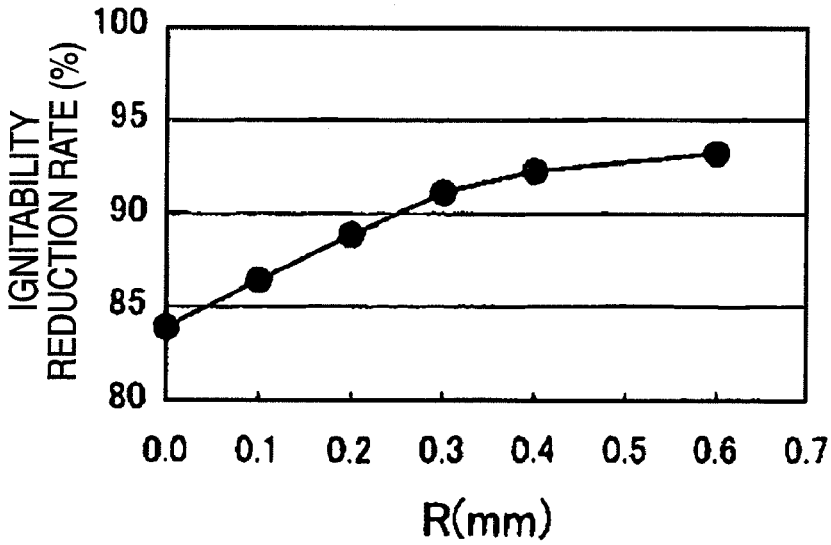
[FIG. 15(A) and FIG. 15(B)] Drawings showing results of an ignitability evaluation test with respect to a chamfering dimension R of a ground electrode of the spark plug 100*a*.
Figure 16:
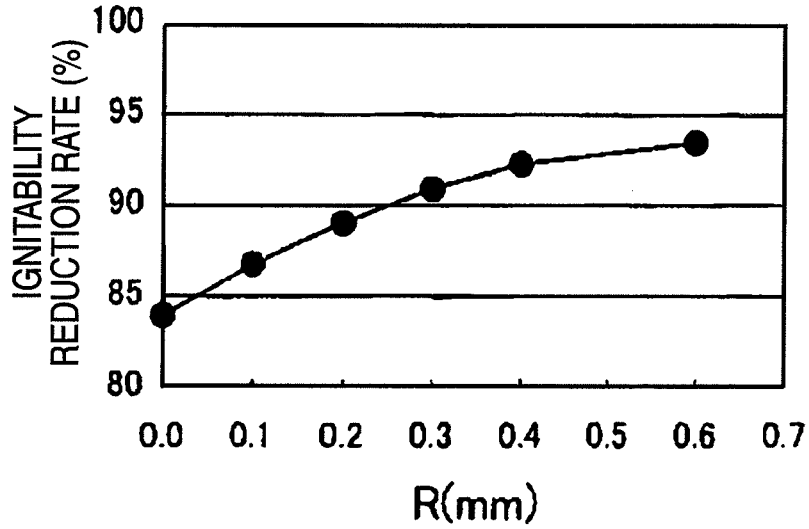
[FIG. 16(A) and FIG. 16(B)] Drawings showing results of another ignitability evaluation test with respect to the chamfering dimension R of a ground electrode of the spark plug 100*a*.

FIG. 15 shows drawings showing test results of an evaluation test with respect to a chamfering dimension R of the ground electrode of the spark plug 100*g*. In addition, FIG. 16 shows drawings showing results of another test with respect to the chamfering dimension R of the ground electrode of the spark plug 100*a*. These ignitability tests were carried out to the method described in FIGS. 8, 9. In addition, spark plugs used then were spark plugs 100*a* described as the second embodiment. Further, in those spark plugs, a projecting dimension of the insulator 10 from the front end face 57 of the metal shell 50 was 1.5 mm and a projecting dimension of the center electrode 20 from the front end face 11 of the insulator 10 was 1.5 mm.

In FIG. 15A, the spark plug 100*a* used as the example No. 76 which constituted a boundary of the determination in the evaluation test shown in FIG. 12A was used as samples. Similarly, in FIG. 16A, the spark plug 100*a* used as the example No. 86 which constituted a boundary of the determination in the evaluation test shown in FIG. 13A was used as samples. Then, stable combustion limit advance angles (·BTDC) were obtained for the respective samples while changing the chamfering dimension R of the ground electrode (FIG. 5), and results of the measurement expressed in percentage denote "ignitability reduction rates (%)." A calculation method of ignitability reduction rate is similar to that described in FIG. 8.

In this evaluation, too, similarly to FIGS. 8 and 9, from the reason that ignitability varies slightly depending upon the orientation of the ground electrode within the combustion chamber, samples whose ignitability reduction rates were about 85% to 90% were "determined" as □ and samples whose ignitability reduction rates were less than 85% were "determined" as x. FIG. 15B is a graph showing results of the evaluation in FIG. 15A. Similarly, FIG. 16B is a graph showing results of the evaluation in FIG. 16A.

It is seen from the results of the evaluation tests that as the chamfering dimension R of the ground electrode increases, the ignitability improves. This is because as the chamfering dimension (mm) over which the four corners of the ground electrode 30*a* in cross section are chamfered increases, the flow of air-fuel mixture into the spark gap is promoted. It is seen from what has been described above that it is preferable that in the spark plug 100*a* of the second embodiment, the chamfering dimension over which the four corners of the ground electrode 30*a* in cross section are chamfered is 0.3 mm or more.

D. Test Result 3 (Test Results with Respect to Sectional Area of Ground Electrode)

Figure 17:
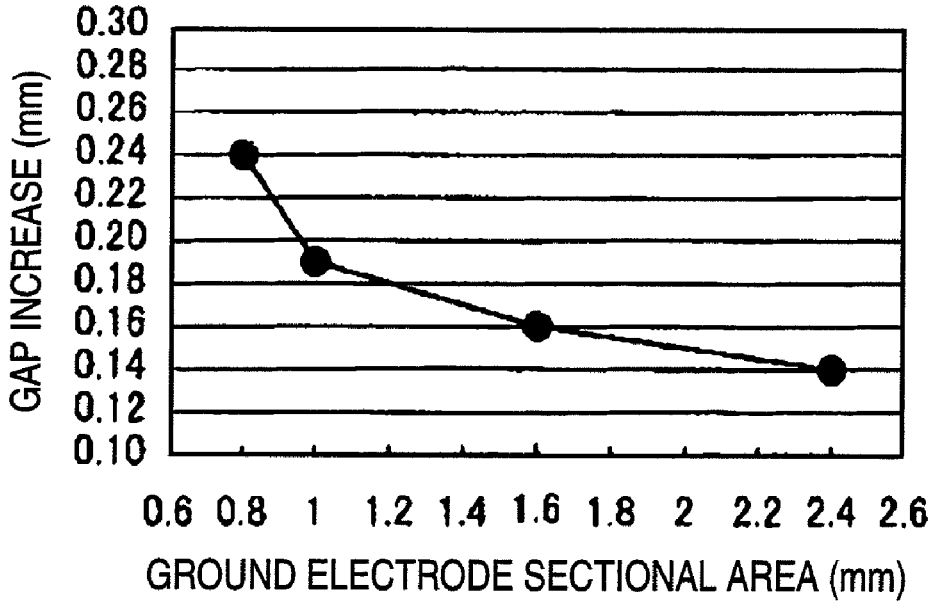
[FIG. 17(A) and FIG. 17(B)] Drawings showing results of a durability evaluation test carried out while changing sectional areas of the ground electrode.

FIG. 17 shows drawings showing results of a durability evaluation test carried out while changing sectional areas of the ground electrode. In this durability evaluation test, spark plugs were mounted in a six-cylinder gasoline engine with a displacement of 2800 cc and the engine was caused to run constantly at 5000 rpm for 100 hours, so as to measure degrees of wear (gap increase in mm) of ground electrodes before and after the test was started. Sample spark plugs used then were spark plugs 100 described as the first embodiment and having the following configurations.

i) Outside diameter of the metal shell 50 is M14.

ii) Initial spark gap between the center electrode 20 and the ground electrode 30 is 0.9 mm.

iii) Projecting dimension of the insulator 10 from the front end face 57 of the metal shell 57 is 1.5 mm.

iv) Projecting dimension of the center electrode 20 from the front end face 11 of the insulator 10 is 1.5 mm.

v) Diameter DD of the front end face 22 of the center electrode 20 (FIG. 3) is 1.3 mm.

vi) Center electrode 20 and ground electrode 30 contain as compositions about 95 wt % Ni, about 1.5 wt % Cr, about 1.5 wt % Si and about 2 wt % Mn.

In FIG. 17A, spark gap increased amounts between the center electrode 20 and the ground electrode 30 were obtained for a plurality of samples numbered as 61 to 64 in which sectional areas in the direction which intersects the longitudinal direction of the ground electrode 30 at right angles (hereinafter, also referred to as a "sectional area of the ground electrode") are changed and measured values were represented as "gap increase (mm)." In this evaluation, the spark plugs whose spark gap increased amounts equaled or exceeded 0.2 mm were "determined" as x from the reason that with the spark gap increased amount of 0.2 mm or more, there is a possibility that a phenomenon referred to as lateral spark jump occurs in which discharge is not performed in a normal position. Then, FIG. 17B is a graph showing the results of the evaluation test in FIG. 17A.

It is seen from the results of the evaluation test that the larger the sectional area of the ground electrode, the smaller the spark gap increased amount, that is, the higher the durability. It is seen from what has been described above that in the spark plug 100 of the first embodiment, it is preferable that the sectional area of the ground electrode is 1 $mm^2$ or more. The spark gap increased amount between the center electrode and the ground electrode is largely dependent on how easily heat can escape from the ground electrode (hereinafter, also referred to as "heat fall"). In general, the spark plug in operation is heated to a constant temperature which matches the running condition, and the temperature becomes highest at a front end of a sparking portion of the spark plug. In addition, the heat fall gets worse as the ground electrode is made thinner. As a result of this, the wearing speed of the ground electrode is increased. Consequently, in order to increase durability, it is seen that the sectional area of the ground electrode is preferably 1 $mm^2$ or more irrespective of the shape of the section of the ground electrode. It is seen from what has been described above that the sectional area of the ground electrode is preferably 1 $mm^2$.

E. Test Result 4 (Test Results with Respect to Ground Electrode Width and Ground Electrode Diameter)

Figure 20:
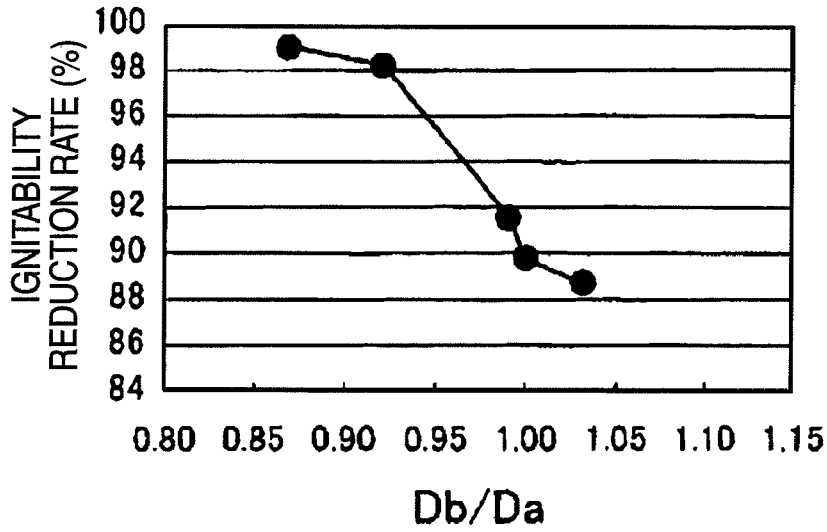
[FIG. 20(A) and FIG. 20(B)] Drawings showing results of an ignitability evaluation test with respect to a width of a ground electrode of the spark plug 100*d*.
Figure 21:
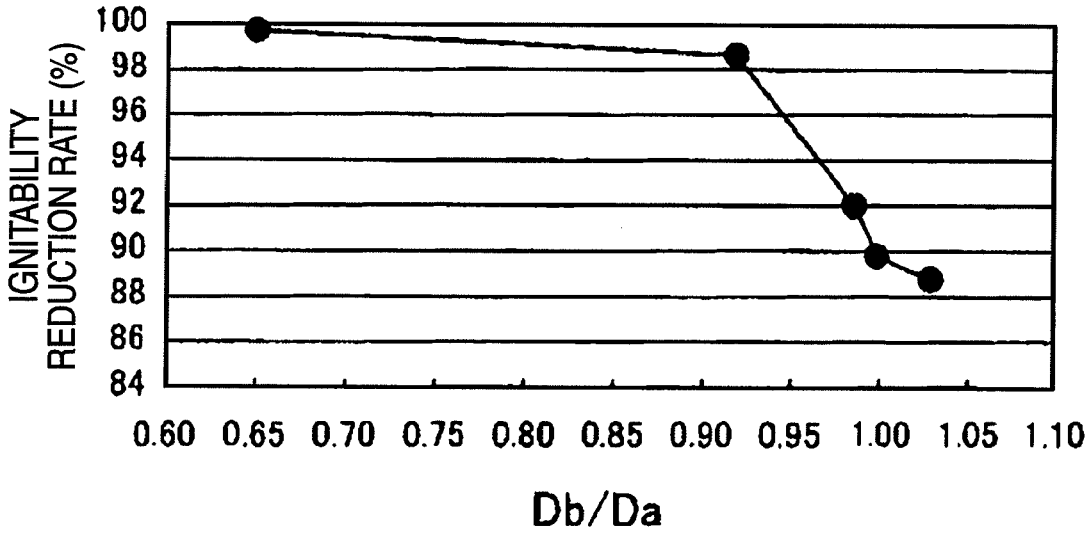
[FIG. 21(A) and FIG. 21(B)] Drawings showing results of another ignitability evaluation test with respect to the width of the ground electrode of the spark plug 100*d*.

FIG. 20 shows drawings showing results of an ignitability evaluation test with respect to the ground electrode width of the spark plug 100*d*. In addition, FIG. 21 shows drawings showing results of another ignitability evaluation test with respect to the ground electrode width of the spark plug 100*d*. These ignitability evaluation tests were carried out to the method described in FIGS. 8 and 9. Spark plugs used then were spark plugs 100*d* described above as the fifth embodiment. Further, in those spark plugs, a projecting dimension of the insulator 10 from the front end face 57 of the metal shell 50 was 1.5 mm and a projecting dimension of the center electrode 20 from the front end face 11 of the insulator 10 was 1.5 mm.

FIG. 20A shows test results on sample Nos. 201 to 205 in which the center electrode width Da (FIG. 18) was fixed to 1.5 mm. FIG. 21A shows test results on sample Nos. 211 to 215 in which the center electrode width Da (FIG. 18) was fixed to 2.0 mm. Since the cross section of the portion which corresponds to the base portion 33*d* and the portion which corresponds to the distal end portion 31*b* have the same diameter, the ground electrode width Db and the ground electrode diameter Sa take the same value. Stable combustion limit advance angles (·BTDC) were obtained for the respective samples while changing the ground electrode width Db (FIG. 18), and measured results shown in percentage were "ignitability reduction rates (%)." A calculation method of ignitability reduction rates is similar to that described in FIG. 8.

In this evaluation, too, similarly to FIGS. 8 and 9, from the reason that ignitability varies slightly depending upon the orientation of the ground electrode within the combustion chamber, samples whose ignitability reduction rates were about 85% to 90% were "determined" as □ and samples whose ignitability reduction rates were less than 85% were "determined" as x. FIG. 20B is a graph showing results of the evaluation in FIG. 20A. Similarly, FIG. 21B is a graph showing results of the evaluation in FIG. 21A.

It is seen from the results of the evaluation tests that the ignitability is improved more as the ratio (Db/Da) of the ground electrode width Db to the center electrode width Da becomes smaller. Further, the test result of the sample No. 201 shown in FIG. 20 is compared with the sample No. 1 (the first embodiment, FIG. 8) and the sample No. 71 (the second embodiment, FIG. 12) which were tested under substantially the same conditions. In the sample No. 201 (Db/Da=0.87), the ignitability reduction rate is 99.1%. On the other hand, the ignitability reduction rate of the sample No. 1 (Db/Da=0.87) is 92.9% and the ignitability reduction rate of the sample No. 71 (Db/Da=0.87) is 98.3%. Consequently, it is seen that in the sample No. 201, the better result can be obtained than those of the samples Nos. 1 and 71.

In addition, the test result of the sample No. 213 shown in FIG. 21 is compared with the sample No. 28 (the first embodiment, FIG. 9) and the sample No. 86 (the second embodiment, FIG. 13) which were tested under substantially the same conditions. In the sample No. 213 (Db/Da=0.99), the ignitability reduction rate is 92.0%. On the other hand, the ignitability reduction rate of the sample No. 28 (Db/Da=0.99) is 84.0% and the ignitability reduction rate of the sample No. 86 (Db/Da=0.99) is 91.1%. Consequently, it is seen that in the sample No. 213, too, the better result can be obtained than those of the samples Nos. 28 and 86.

It is seen from these test results that in the spark plug 100*d* of the fifth embodiment, the variation in ignition performance due to the orientation of the ground electrode within the combustion chamber is reduced further. This is because since the shape of the base portion becomes the substantially cylindrical shape, the air-fuel mixture is sent out smoothly to the spark point. It is seen from these test results that in the spark plug 100*d* of the fifth embodiment, it is preferable to satisfy the relationship expressed by Db/Da≦0.99 and it is more preferable to satisfy relationship expressed by Db/Da≦0.92.

Test Result 5 (Test Result with Respect to Length of Flat Portion of the Ground Electrode)

FIG. 22 shows drawings showing results of a durability evaluation test carried out while changing lengths of the flat portion of the ground electrode. In this durability evaluation test, spark plugs were mounted in a three-cylinder gasoline engine with a displacement of 660 cc and the engine was caused to run constantly at 6000 rpm for 150 hours, so as to measure degrees of wear (gap increase in mm) of ground electrodes before and after the test was started. Sample spark plugs used then were spark plugs 100*d* described as the fifth embodiment and having the following configurations.

i) Outside diameter of the metal shell 50 is M10.

ii) Initial spark gap between the center electrode 20 and the ground electrode 30 is 0.85 mm.

iii) Length from the front end face 57 of the metal shell 50 to the front end face 22 of the center electrode 20 is 3.0 mm.

iv) Diameter DD of the front end face 22 of the center electrode 20 (FIG. 3) is 2.0 mm (samples Nos. 221 to 223) and 2.5 mm (samples Nos. 231 to 233).

In FIG. 22A, spark gap increased amounts between the center electrode 20 and the ground electrode 30 were obtained for the samples Nos. 221 to 223 in which the length Sc of the flat portion of the ground electrode 30 (FIG. 18) was changed, and the amounts so obtained were represented as "gap increases (in mm)." In this evaluation, the spark plugs whose spark gap increased amounts equaled or exceeded 0.2 mm were "determined" as x from the reason that with the spark gap increased amount of 0.2 mm or more, there is a possibility that a phenomenon referred to as lateral spark jump occurs in which discharge is not performed in a normal position. FIG. 22B is a graph showing the results of the evaluation of the samples Nos. 221 to 223 in FIG. 22A. Similarly, FIG. 22C is a graph showing the results of the evaluation of the samples Nos. 231 to 233 in FIG. 22A.

It is seen from the results of the evaluation test that as the length Sc of the flat portion increases, the spark gap increased amount decreases, that is, the durability increases. It is seen from what has been described above that in the spark plug 100*d* of the fifth embodiment, the length Sc of the flat portion is preferably 0.57 mm or more and more preferably 0.75 mm or more.

Test Result 6 (Test Results with respect to Compositions of Center Electrode)

FIG. 23 shows drawings showing results of a durability evaluation test carried out while changing compositions of the center electrode. In this durability evaluation test, spark plugs were mounted in a three-cylinder gasoline engine with a displacement of 660 cc and the engine was caused to run constantly at 4000 rpm for 100 hours with a stable combustion limit advance angle (·BTDC) of 5° and an air-fuel ratio (A/F) of 10.7, so as to measure degrees of wear (gap increase in mm) of center electrodes before and after the test was started. Sample spark plugs used then were spark plugs 100*d* described as the fifth embodiment and having the following configurations.

i) Outside diameter of the metal shell 50 is M10.

ii) Initial spark gap between the center electrode 20 and the ground electrode 30 is 0.85 mm.

iii) Length from the front end face 57 of the metal shell 50 to the front end face 22 of the center electrode 20 is 3.0 mm.

iv) Diameter DD of the front end face 22 of the center electrode 20 (FIG. 3) is 1.5 mm.

v) Width Sa of the distal end portion 31*d* of the ground electrode 30 is 1.3 mm.

FIG. 23A shows compositions of the ground electrodes 30*d* used for the durability evaluation test. In FIG. 23B, spark gap increased amounts between the center electrode 20 and the ground electrode 30 were obtained for the samples Nos. 301 to 304 in which the composition of the center electrode 20 was changed, and the amounts so obtained were represented as "gap increases (in mm)." In this evaluation, the spark plugs whose spark gap increased amounts equaled or exceeded 0.2 mm were "determined" as x (no good) from the reason that with the spark gap increased amount of 0.2 mm or more, there is a possibility that a phenomenon referred to as lateral spark jump occurs in which discharge is not performed in a normal position. FIGS. 23A, 23B show the results in weight percentage (wt %) as unit. In addition, Ni is obtained as a value resulting by subtracting analyzed values (wt %) of other materials from 100 wt %.

It is seen from the results of the evaluation test that as the ratio of Ni to the other compositions of the center electrode 20 increases, the spark gap increased amount decreases, that is, the durability increases. The center electrode 20 projects less into the combustion chamber than the ground electrode 30*d*, and the temperature is made difficult to increase. Because of this, it is preferable that an electrode material is used for the center electrode 20 in which importance is given to spark wear resistance, which contains few additives and which has a small specific resistance.

It is seen from what has been described above that in the spark plug 100*d* of the fifth embodiment, the center electrode 20 is made of a Ni allow which contains 96.5 wt % or more Ni.

In addition, from the same reason, similarly in the spark plugs of the other embodiments, the center electrode is preferably made of the Ni alloy which contains 96.5 wt % or more Ni.

Test Result 7 (Test Results with Respect to Composition of Ground Electrode)

FIG. 24 shows drawings showing results of a durability evaluation test carried out while changing compositions of the ground electrode. This durability evaluation test was carried out to the method described in FIG. 23. In addition, sample spark plugs used then were spark plugs 100*d* described as the fifth embodiment and having the same configuration as the configuration described in FIG. 23.

FIG. 24A shows compositions of the center electrodes 20 used for the durability evaluation test. In FIG. 24B, spark gap increased amounts between the center electrode 20 and the ground electrode 30 were obtained for samples Nos. 311 to 313 in which the composition of the ground electrode 30*d* was changed, and the amounts so obtained were represented as "gap increases (in mm)." In this evaluation, the spark plugs whose spark gap increased amounts equaled or exceeded 0.2 mm were "determined" as x (no good) from the reason that with the spark gap increased amount of 0.2 mm or more, there is a possibility that a phenomenon referred to as lateral spark jump occurs in which discharge is not performed in a normal position. FIGS. 24A, 24B both show the results in weight percentage (wt %) as unit. In addition, Ni is obtained as a value resulting by subtracting analyzed values (wt %) of other materials from 100 wt %.

It is seen from the results of the evaluation test that as the ratio of Cr to the other compositions of the ground electrode 30*d* increases, the spark gap increased amount decreases, that is, the durability increases. The ground electrode 30*d* projects more into the combustion chamber than the center electrode 20, and the temperature is made easy to increase. Further, in the ground electrode 30*d* of this embodiment, since the ground electrode 30*d* is formed narrower than the center electrode 20, the temperature of the ground electrode 30*d* is easy to increase. Because of this, it is preferable that an electrode material is used for the ground electrode 30*d* in which importance is given to oxidation resistance and which contains much Cr which forms a stable oxide layer.

It is seen from what has been described above that in the spark plug 100*d* of the fifth embodiment, the ground electrode 30*d* is made of a Ni allow which contains 15 wt % or more Cr. In addition, from the same reason, similarly in the spark plugs of the other embodiments, the ground electrode is preferably made of the Ni alloy which contains 15 wt % or more Cr.

I. Modified Examples

Note that the invention is not limited to the examples and the embodiments that have been described heretofore and can be embodied variously without departing from the spirit and scope thereof. The following modified examples can be provided.

I1. Modified Example 1

In the embodiments, although the spark plug has been described as the spark plug of vertical discharge type, the positional relationship between the distal end portion of the ground electrode and the front end portion of the center electrode can be set as required depending upon applications and required performances of spark plugs. In addition, a configuration can be adopted in which a plurality of ground electrodes are provided for one center electrode.

I2. Modified Example 2

In the embodiment, the cross section of the ground electrode has been described as being substantially rectangular, substantially elliptical or substantially circular shape. However, the shape of the cross section of the ground electrode is not limited to these shapes, and hence, the cross section of the ground electrode can be formed into various shapes.

DESCRIPTION OF REFERENCE NUMERALS

3 ceramic resistance;
4 seal material;
5 gasket;
6 ring member;
7 ring member;
8 plate packing;
9 talc;
10 insulator;
11 front end face;
12 axial hole;
13 nose portion;
15 step portion;
17 front end side body portion;
18 rear end side body portion;
19 flange portion;
20 center electrode;
20*c* shoulder portion;
21 electrode base material;
22 front end face;
25 core material;
30, 30*a* to *e* ground electrode;
31, 31*a* to 3 distal end portion;
32, 32*a* to *e* discharge plane;
33, 33*a* to *e* base portion;
34, 34*a* to *c* proximal end portion;
40 plug cable terminal;
50 metal shell;
51 tool engagement portion;
52 attaching screw portion;
53 crimping portion;
54 seal portion;
55 bearing surface;
56 step portion;
57 front end face;
58 buckling portion;
59 screw neck;
100, 100*a* to *e* spark plug;
200 cylinder head;
201 mounting screw hole;
205 opening circumferential portion.

The invention claimed is:

1. A spark plug comprising:

a center electrode extending along an axial direction;

an insulator provided on a periphery of the center electrode;

a cylindrical metal shell surrounding the insulator in a radial direction; and a ground electrode including a discharge surface perpendicular or substantially perpendicular to the axial direction, and forming a spark gap defined between the discharge surface and a leading end of the center electrode, wherein the center electrode and the ground electrode are not provided with a noble metal member, when defining a downward direction as a direction of the axial direction directing from the center electrode to the discharge surface of the ground electrode, and defining an upward direction as a direction of the axial direction opposite to the downward direction, and the ground electrode comprises:

a base portion combined with the metal shell and positioned at the upward direction side of the discharge surface; and a distal end portion including the discharge surface and positioned at the downward direction side of the base portion while continuing from the base portion, wherein when defining a first direction as a direction perpendicular to the axial direction and directing from the base portion to the center electrode, defining a width of the center electrode viewed from the first direction as Da, and defining a width of the base portion viewed from the first direction as Db, Da and Db satisfies $0.87 \leqq Db/Da \leqq 0.92$.

2. A spark plug comprising:

a center electrode extending along an axial direction;

an insulator provided on a periphery of the center electrode;

a cylindrical metal shell surrounding the insulator in a radial direction; and a ground electrode including a discharge surface perpendicular or substantially perpendicular to the axial direction, and forming a spark gap defined between the discharge surface and a leading end of the center electrode, wherein the center electrode and the ground electrode are not provided with a noble metal member, when defining a downward direction as a direction of the axial direction directing from the center electrode to the discharge surface of the ground electrode, and defining an upward direction as a direction of the axial direction opposite to the downward direction, and the ground electrode comprises:

a base portion combined with the metal shell and positioned at the upward direction side of the discharge surface; and a distal end portion including the discharge surface and positioned at the downward direction side of the base portion while continuing from the base portion, wherein when defining a first direction as a direction perpendicular to the axial direction and directing from the base portion to the center electrode, defining a width of the center electrode viewed from the first direction as Da, and defining a width of the base portion viewed from the first direction as Db, Da and Db satisfies $0.87 \leqq Db/Da \leqq 0.99$, a plane of the distal end portion viewed from a direction opposite to the first direction has a shape whose four corners are chamfered with a curve or line, and a dimension of the chamfering is equal to or larger than 0.3 mm.

3. A spark plug comprising:

a center electrode extending along an axial direction;

an insulator provided on a periphery of the center electrode;

a cylindrical metal shell surrounding the insulator in a radial direction; and a ground electrode including a discharge surface perpendicular or substantially perpendicular to the axial direction, and forming a spark gap defined between the discharge surface and a leading end of the center electrode, wherein the center electrode and the ground electrode are not provided with a noble metal member, when defining a downward direction as a direction of the axial direction directing from the center electrode to the discharge surface of the ground electrode, and defining an upward direction as a direction of the axial direction opposite to the downward direction, and the ground electrode comprises:

a base portion combined with the metal shell and positioned at the upward direction side of the discharge surface; and a distal end portion including the discharge surface and positioned at the downward direction side of the base portion while continuing from the base portion, wherein when defining a first direction as a direction perpendicular to the axial direction and directing from the base portion to the center electrode, defining a width of the center electrode viewed from the first direction as Da, and defining a width of the base portion viewed from the first direction as Db, Da and Db satisfies $0.87 \leqq Db/Da \leqq 0.99$, a plane of the distal end portion viewed from a direction opposite to the first direction has a shape obtained by cutting a circular shape with a line, and the discharge plane is a plane corresponds to a chord of the shape obtained by cutting the circular shape with a line.

4. The spark plug according to claim 3, wherein Db and Da satisfy $Db/Da \leqq 0.92$.

5. The spark plug according to claim 3, wherein a length of the chord of the shape obtained by cutting the circle with a line is equal to or longer than 0.57 mm.

6. The spark plug according to claim 1, wherein the center electrode and the ground electrode are formed so that, when projecting the ground electrode onto the center electrode along the first direction, a shade of the ground electrode projected onto the center electrode is not formed on two shoulder portions of the distal end plane of the center electrode.

7. The spark plug according to claim 1, wherein a width of the distal end portion is equal to the width of the base portion when viewed from the first direction.

8. The spark plug according to claim 1, wherein a cross section of the center electrode perpendicular to the axial direction is a circle whose diameter DD satisfies $1.3\ mm \leqq DD \leqq 2\ mm$.

9. The spark plug according to claim 1, wherein the base portion of the ground electrode and the distal end portion of the ground electrode have a same cross section area, and the cross section area is equal to or larger than 1 $mm^2$.

10. The spark plug according to claim 1, wherein a thread diameter of a screw engaged with an engine head of the metal shell is equal to or smaller than M10.

11. The spark plug according to claim 1, wherein the center electrode is a Ni alloy containing Ni equal to or more than 96.5 wt %.

12. The spark plug according to claim 1, wherein the ground electrode is a Ni alloy containing Cr equal to or more than 15 wt %.

* * * * *